US010472960B2

(12) United States Patent
Lee et al.

(10) Patent No.: US 10,472,960 B2
(45) Date of Patent: Nov. 12, 2019

(54) ESTIMATING CONTAMINATION DURING FOCUSED SAMPLING

(71) Applicant: Schlumberger Technology Corporation, Sugar Land, TX (US)

(72) Inventors: Ryan Sangjun Lee, Sugar Land, TX (US); Adriaan Gisolf, Houston, TX (US); Youxiang Zuo, Burnaby (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 222 days.

(21) Appl. No.: 14/975,708

(22) Filed: Dec. 18, 2015

(65) Prior Publication Data

US 2016/0186562 A1 Jun. 30, 2016

Related U.S. Application Data

(60) Provisional application No. 62/098,204, filed on Dec. 30, 2014.

(51) Int. Cl.
*E21B 49/08* (2006.01)
*G06Q 50/02* (2012.01)

(52) U.S. Cl.
CPC ..... *E21B 49/081* (2013.01); *G06Q 50/02* (2013.01); *E21B 2049/085* (2013.01)

(58) Field of Classification Search
CPC . E21B 2049/085; E21B 41/005; G06Q 50/02; G01N 33/2841
USPC ..... 702/6
See application file for complete search history.

(56) References Cited

U.S. PATENT DOCUMENTS

| | | | | |
|---|---|---|---|---|
| 6,108,608 | A * | 8/2000 | Watts, III | E21B 49/00 702/30 |
| 6,274,865 | B1 | 8/2001 | Schroer et al. | |
| 6,350,986 | B1 | 2/2002 | Mullins et al. | |
| 9,557,312 | B2 | 1/2017 | Zuo et al. | |
| 2002/0016703 | A1* | 2/2002 | Barroux | G01N 33/2823 703/10 |
| 2003/0182061 | A1* | 9/2003 | Ferworn | E21B 49/087 702/12 |
| 2004/0104341 | A1* | 6/2004 | Betancourt | E21B 47/10 250/255 |
| 2007/0119244 | A1* | 5/2007 | Goodwin | E21B 47/10 73/152.28 |

(Continued)

*Primary Examiner* — Dzung Tran
(74) *Attorney, Agent, or Firm* — Trevor G. Grove

(57) ABSTRACT

Disclosed are methods and apparatus pertaining to processing in-situ, real-time data associated with fluid obtained by a downhole sampling tool. The processing includes generating a population of values for $\hat{C}$, where each value of $\hat{C}$ is an estimated value of a fluid property for native formation fluid within the obtained fluid. The obtained data is iteratively fit to a predetermined model in linear space. The model relates the fluid property to pumpout volume or time. Each iterative fitting utilizes a different one of the values for $\hat{C}$. A value $\hat{C}^*$ is identified as the one of the values for $\hat{C}$ that minimizes model fit error in linear space based on the iterative fitting. Selected values for $\hat{C}$ that are near $\hat{C}^*$ are then assessed to determine which one has a minimum integral error of nonlinearity in logarithmic space.

20 Claims, 18 Drawing Sheets

(56) References Cited

U.S. PATENT DOCUMENTS

| | | | | |
|---|---|---|---|---|
| 2009/0030858 | A1* | 1/2009 | Hegeman | E21B 49/10 706/17 |
| 2014/0360257 | A1* | 12/2014 | Indo | E21B 47/102 73/152.28 |

* cited by examiner

ESTIMATING CONTAMINATION DURING FOCUSED SAMPLING

CROSS-REFERENCE TO RELATED APPLICATIONS

This application claims the benefit of and priority to U.S. Provisional Application No. 62/098,204, entitled "Estimating Contamination During Focused Sampling," filed Dec. 30, 2014, the entire disclosure of which is hereby incorporated herein by reference.

BACKGROUND OF THE DISCLOSURE

Oil-based mud (OBM) contamination monitoring (OCM) was developed to estimate the contamination level of incoming fluid during non-focused sampling. For focused sampling, the same OCM approach has been used to estimate the contamination of synthetic commingled fluids utilizing measured flow rates of sample and guard flowlines, assuming that the commingled flow of a focused sampling tool behaves like a non-focused sampling tool. However, in focused sampling, the contamination level in the sample flowline cannot be accurately estimated during early phases of cleanup because it is too early to accurately estimate the optical density (OD) of a formation fluid using the behavior of a commingled flow. That is, average contamination is still too high to obtain accurate estimation, due to slow cleanup at the guard inlet. Moreover, the commingled behavior of a focused sampling tool is not identical to the cleanup behavior of a non-focused sampling tool, such that large discrepancies are observed with non-zero differential pressure between the sample and guard inlets. The computation of commingled flow based on flow measurements with error may also introduce greater uncertainty.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a method that includes obtaining in-situ, real-time data associated with fluid obtained by a downhole sampling tool disposed in a borehole that extends into a subterranean formation. The obtained fluid includes native formation fluid and filtrate contamination resulting from formation of the borehole. The downhole sampling tool is in electrical communication with surface equipment disposed at a wellsite surface from which the borehole extends. The obtained data includes values of a fluid property of the obtained fluid relative to: (1) a pumpout volume of the fluid pumped from the subterranean formation by the downhole sampling tool; or (2) a pumpout time during which the fluid is pumped from the subterranean formation by the downhole sampling tool. The method also includes, via operation of at least one of the downhole sampling tool and the surface equipment: generating a population of values for $\hat{C}$, where each value of $\hat{C}$ is an estimated value of the fluid property for the native formation fluid; iteratively fitting the obtained data to a predetermined model in linear space, where the model relates the fluid property to the pumpout volume or time, and where each iterative fitting utilizes a different one of the values for $\hat{C}$; identifying as $\hat{C}^*$ which one of the values for $\hat{C}$ minimizes model fit error in linear space based on the iterative fitting of the obtained data; selecting ones of the values for $\hat{C}$ that are near $\hat{C}^*$; and determining which one of the selected ones of the values for $\hat{C}$ near $\hat{C}^*$ has a minimum integral error of nonlinearity (IEN) in logarithmic space.

The present disclosure also introduces a method that includes obtaining in-situ, real-time data associated with fluid obtained by a downhole sampling tool disposed in a borehole that extends into a subterranean formation. The obtained fluid includes native formation fluid and filtrate contamination resulting from formation of the borehole. The downhole sampling tool is in electrical communication with surface equipment disposed at a wellsite surface from which the borehole extends. The obtained data includes values of a fluid property of the obtained fluid relative to: (1) a pumpout volume of the fluid pumped from the subterranean formation by the downhole sampling tool; or (2) a pumpout time during which the fluid is pumped from the subterranean formation by the downhole sampling tool. The method also includes, via operation of at least one of the downhole sampling tool and the surface equipment: generating a population of values for $\hat{C}$, where each value of $\hat{C}$ is an estimated value of the fluid property for the native formation fluid; and determining which one of the values for $\hat{C}$ has a minimum integral error of nonlinearity (IEN) in logarithmic space.

The present disclosure also introduces a method that includes obtaining in-situ, real-time data associated with fluid obtained by a downhole sampling tool disposed in a borehole that extends into a subterranean formation. The downhole sampling tool is in electrical communication with surface equipment disposed at a wellsite surface from which the borehole extends. The obtained data includes values of a fluid property of the obtained fluid. The method also includes, via operation of at least one of the downhole sampling tool and the surface equipment, filtering the obtained data utilizing a robust moving percentile (RMP) filter. Filtering the obtained data utilizing the RMP filter includes: obtaining parameters for a data window to be moved through multiple window locations individually utilized to collectively filter the obtained data, where the parameters include a window size and a window target percentile range between upper and lower percentiles; and at each of the window locations: (i) determining which of the obtained data values correspond to the upper and lower percentiles of the obtained data within the window at the current window location; (ii) replacing the obtained data within the window at the current window location with random data having values ranging between the obtained data values determined to correspond to the upper and lower percentiles; (iii) smoothing the random data; and (iv) determining a filtered data point for the current window location based on the smoothed random data.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
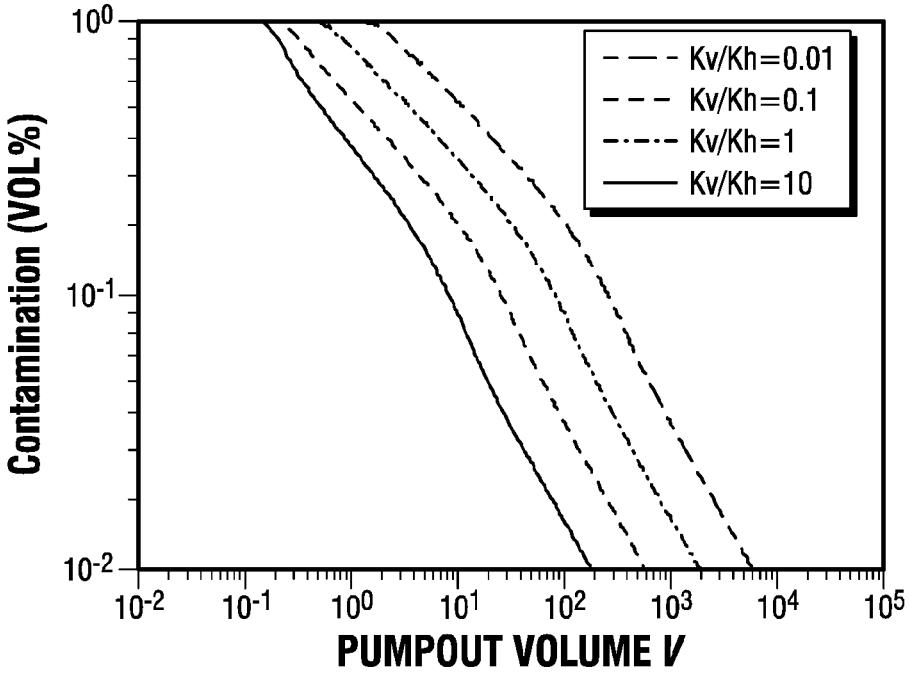
FIG. 1 is a graph depicting example cleanup behavior of a non-focused sampling probe at different anisotropic ratios.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Formation fluid may be obtained from a subterranean formation by a downhole sampling tool via focused or non-focused sampling. In non-focused sampling, a mixture of formation fluid and filtrate contamination is pumped through one or more inlets of the downhole sampling tool (and then into the borehole) during a cleanup operation until an acceptably low level of filtrate contamination is achieved, at which time the sufficiently "clean" formation fluid is directed to a sample chamber of the downhole sampling tool. In focused sampling, after a substantially shorter cleanup operation, sufficiently clean formation fluid flows into a sampling inlet and corresponding flowline, while contaminated fluid continues to flow into a separate guard inlet and corresponding flowline. Thus, the contaminated fluid can be separated from the native (or at least less contaminated) formation fluid in an earlier stage of the sampling process, thereby decreasing the length of the cleanup operation and expediting collection of a sufficiently decontaminated sample of the native formation fluid in the sample chamber of the downhole sampling tool.

Current OCM processes were originally developed for non-focused sampling. Based on theoretical studies conducted in the past, it has been observed that the late-phase behavior of formation fluid contamination cleanup is exponential. FIG. 1 is a graph depicting example cleanup behavior of a non-focused sampling tool at different anisotropic ratios. The anisotropic ratio is the ratio of vertical anisotropy (Kv) to horizontal anisotropy (Kh). The late-phase cleanup process shows exponential behavior, which appears as a substantially straight line in the logarithmic scale (of both the X- and Y-axes) of FIG. 1.

The mixing rules utilized for OCM may be as set forth below in Equation (1).

$$v_{OBM} = \frac{OD_0 - OD}{OD_0 - OD_{OBM}} = \frac{\rho_0 - \rho}{\rho_0 - \rho_{OBM}} = b\frac{GOR_0 - GOR}{GOR_0} = \frac{b - b_0}{b_{OBM} - b_0} = \beta V^{-\gamma} \quad (1)$$

where:

- b is the shrinkage factor of the contaminated fluid obtained by the downhole sampling tool;
- $b_0$ is the shrinkage factor of the native formation fluid;
- $b_{OBM}$ is the shrinkage factor of the OBM filtrate in the contaminated fluid obtained by the downhole sampling tool;
- β is an adjustable parameter obtained experimentally and/or via fitting the data obtained by the downhole sampling tool;
- OD is the optical density of the contaminated fluid obtained by the downhole sampling tool (referred to as apparent optical density) and measured by the downhole sampling tool;
- $OD_0$ is the optical density of the native formation fluid;
- $OD_{OBM}$ is the optical density of the OBM filtrate in the contaminated fluid obtained by the downhole sampling tool;
- GOR is the gas-oil-ratio (GOR) of the contaminated fluid obtained by the downhole sampling tool (referred to as apparent GOR) and determined based on the OD, for example;

$GOR_0$ is the GOR of the native formation fluid;

$\gamma$ is an adjustable parameter obtained experimentally and/or via fitting the data obtained by the downhole sampling tool;

$\rho$ is the density of the contaminated fluid obtained by the downhole sampling tool (referred to as apparent density) and measured by the downhole sampling tool or determined based on the OD, for example;

$\rho_0$ is the density of the native formation fluid;

$\rho_{OBM}$ is the density of the OBM filtrate in the contaminated fluid obtained by the downhole sampling tool;

V is the volume of contaminated fluid pumped by the downhole sampling tool; and $\nu_{OBM}$ is the volume percentage of the OBM filtrate in the contaminated fluid obtained by the downhole sampling tool.

In the following description, OD is used as an example. However, the description may be adapted for use with other fluid properties, such as GOR, mass density, shrinkage factor, formation volume factor, fluorescence, dielectric constant, viscosity, and/or composition, among other examples. The description may also be adapted for use with the f function or the g function set forth below in Equations (2) and (3).

$$f=[GOR_0-(GOR_0-GOR)b] \tag{2}$$

$$g=(GOR_0-GOR)b \tag{3}$$

The description may also be adapted for water-based mud (WBM) contamination monitoring (WCM). In such implementations, mass density and/or conductivity (reciprocal of resistivity) may be utilized instead of OD, among other example substitute parameters.

During OCM according to one or more aspects of the present disclosure, $OD_0$ is estimated by fitting the asymptotic, exponential model set forth below in Equation (4) to the OD measurement data in the least-squares sense.

$$OD(V)=C-D\times V^{-\gamma} \tag{4}$$

where C is $OD_0$, and where D and $\gamma$ are the fitting parameters controlling the evolution of contamination.

Based on previous analytical studies for non-focused sampling, the value of the exponent $\gamma$ in the model of Equation (4) was fixed as a constant. With a fixed exponent $\gamma$, $OD_0$ can be determined using linear least squares fitting, because the problem becomes linear in parameters, as set forth below in Equation (5).

$$Ax = b, \tag{5}$$

where $$A = \begin{bmatrix} 1 & -V_1^{-\gamma} \\ \vdots & \vdots \\ 1 & -V_n^{-\gamma} \end{bmatrix},$$

$$x = [\,C \quad D\,],$$

$$b = \begin{bmatrix} OD_1 \\ \vdots \\ OD_n \end{bmatrix} \therefore x = (A^TA)^{-1}A^Tb$$

Figure 2:
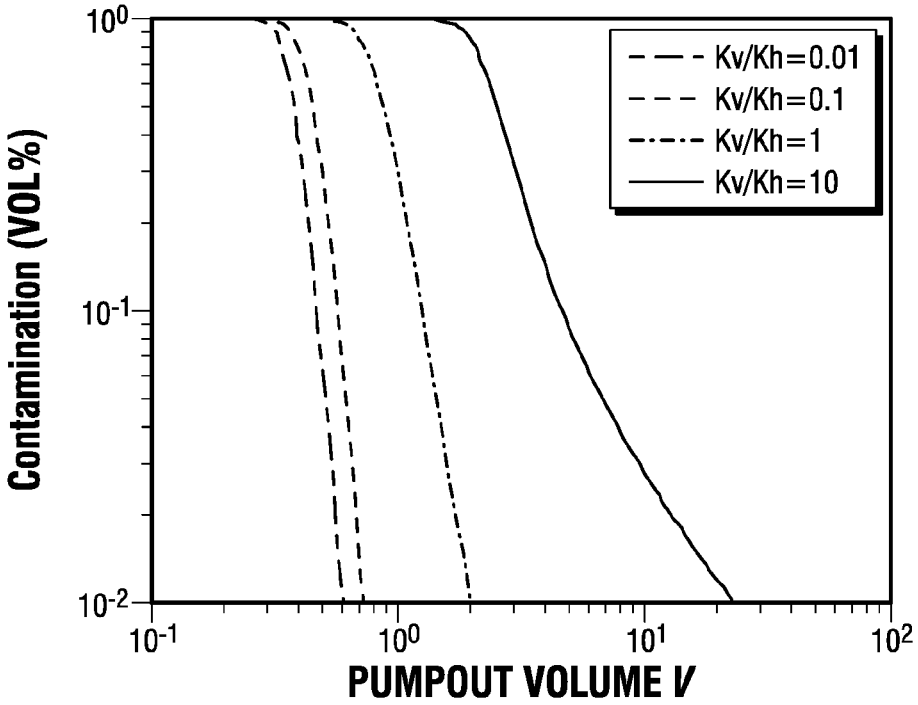
FIG. 2 is a graph depicting, for an example focused sampling implementation, example cleanup behavior of the sample flowline at different anisotropic ratios.

However, the sample flowline behavior of focused sampling is significantly more complicated than that of non-focused sampling, which makes the fixed-power law inapplicable. For example, FIG. 2 is a graph depicting, for an example focused sampling implementation, example cleanup behavior of the sample flowline at the same anisotropic ratios depicted in FIG. 1. Unlike the non-focused example shown in FIG. 1, the late-phase behavior of the focused sampling sample flowline shows noticeable variation with different anisotropic ratios. For example, as shown in the example cleanup data depicted in FIG. 1, the contamination curves for each anisotropic ratio Kv/Kh generally follow the same trend, while in the example cleanup data depicted in FIG. 2, the cleanup for the anisotropic ratio Kv/Kh=1 is substantially slower than for the smaller anisotropic ratios of 0.01 and 0.1, and the cleanup for the anisotropic ratio of 10 is dramatically slower than each of the other anisotropic ratios.

In existing OCM algorithms, assuming that the commingled flow of a focused sampling tool behaves like a non-focused sampling tool, the same method with a fixed exponent has been used to estimate $OD_0$. In such implementations, a synthetic commingled flow is computed using measured flow rates of the sample and guard flowlines. As described above, however, the contamination level of the sample flowline cannot be accurately estimated even when the sample flowline reaches very low contamination level, because it is still too early to accurately estimate $OD_0$ based on the synthetic commingled flow. Moreover, the computation of commingled flow based on flow measurements with error can exacerbate uncertainty.

Thus, as described below, the present disclosure introduces methods for estimating $OD_0$ using the sample flowline OD measurements by estimating the three parameters (C, D, and $\gamma$) of the model set forth above in Equation (4). This makes the problem nonlinear, which can be solved with an iterative optimization algorithm via nonlinear curve fitting. However, the result of the nonlinear curve fitting can be sensitive to measurement data noise.

Figure 3:
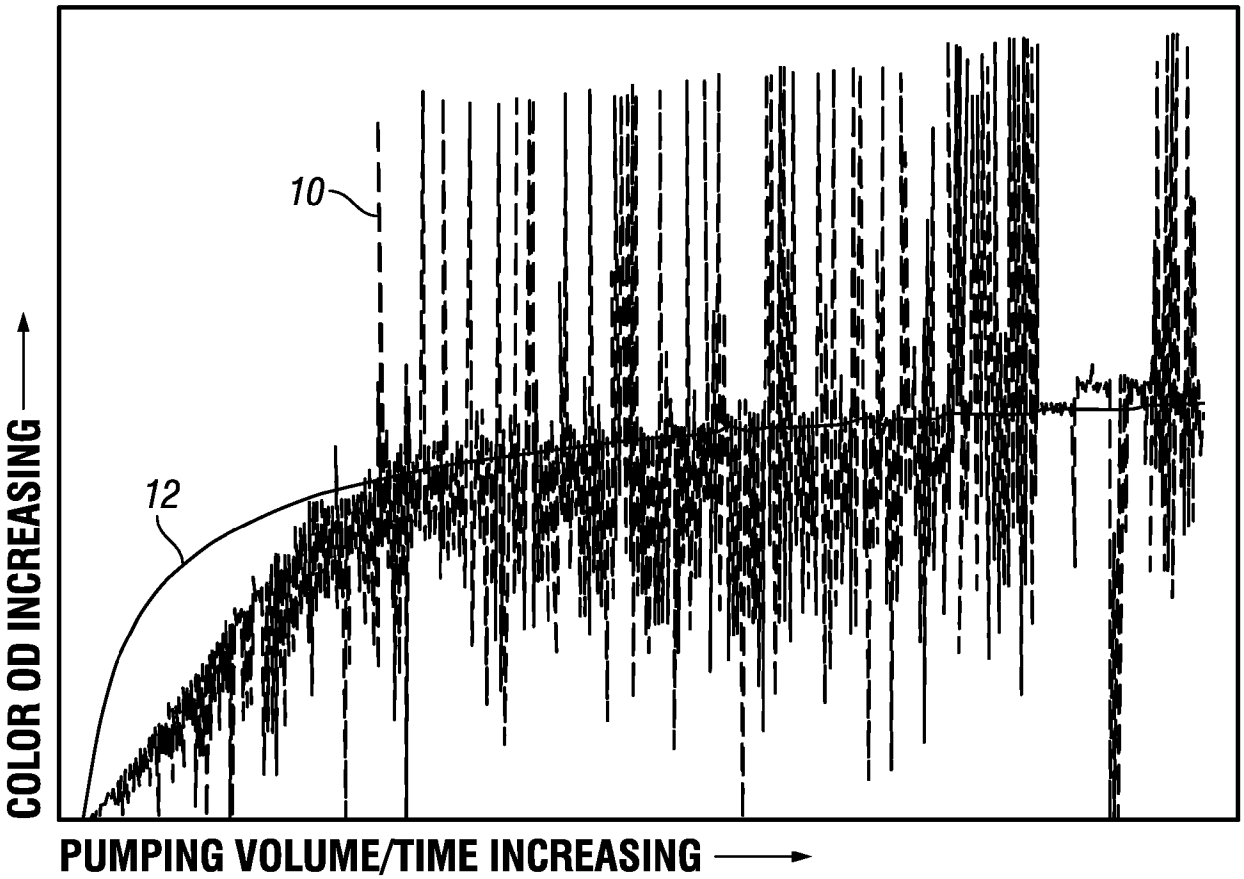
FIGS. 3-9 are graphs depicting example OD measurements corrupted by noise.
Figure 4:
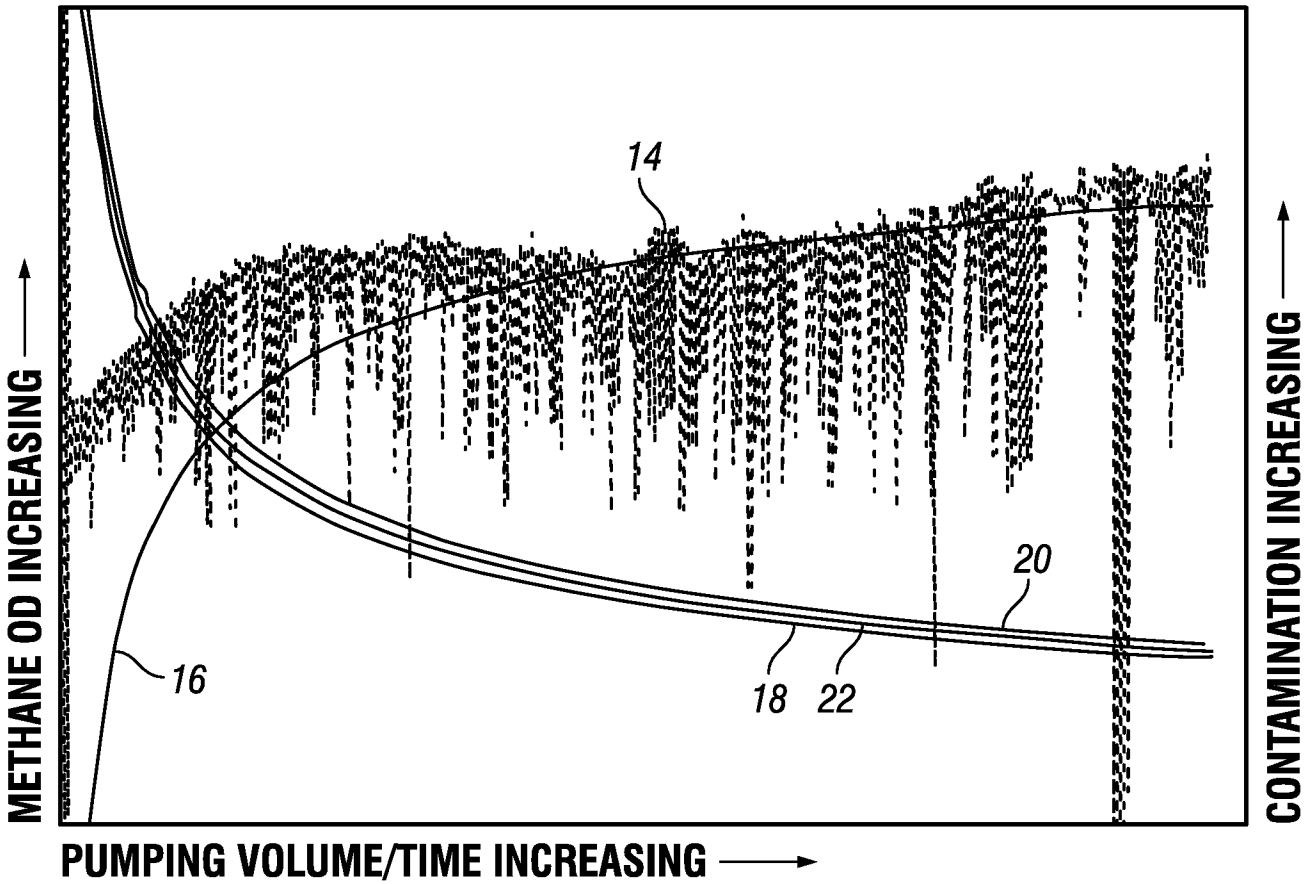
Figure 5:
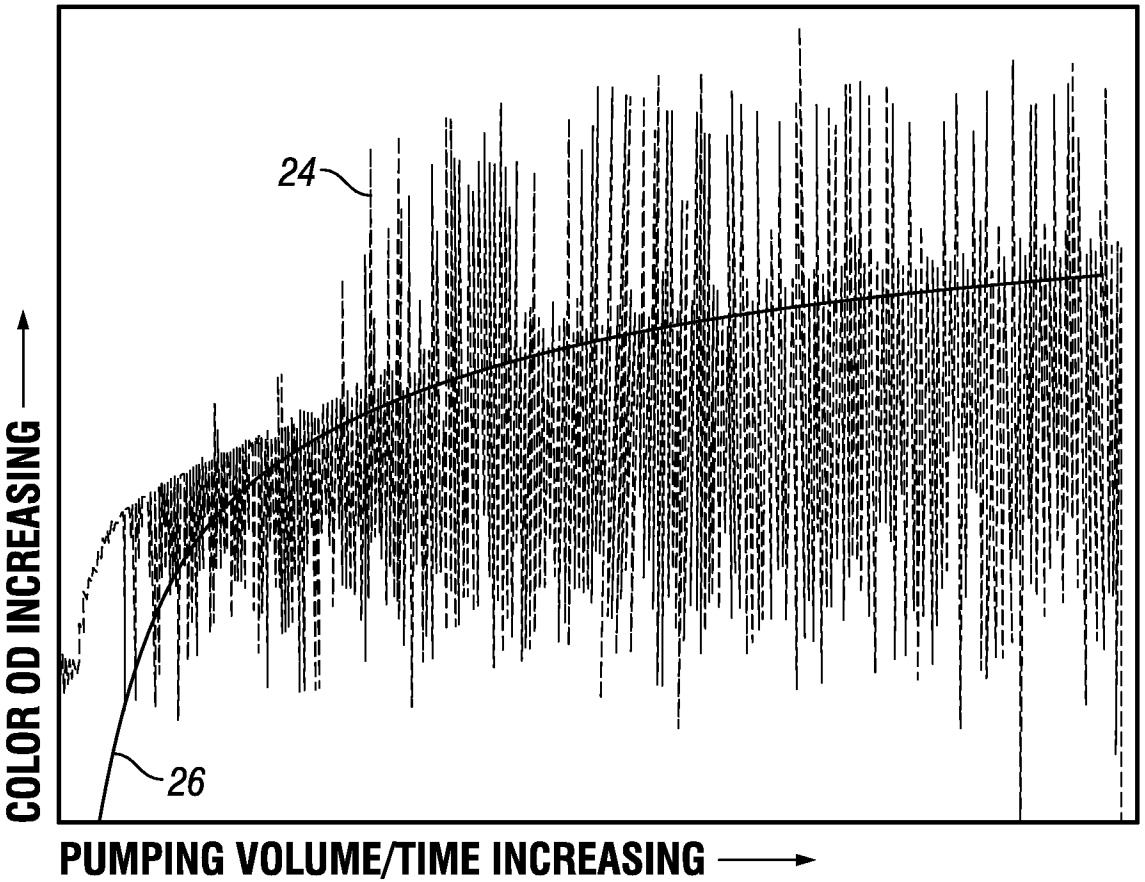
Figure 6:
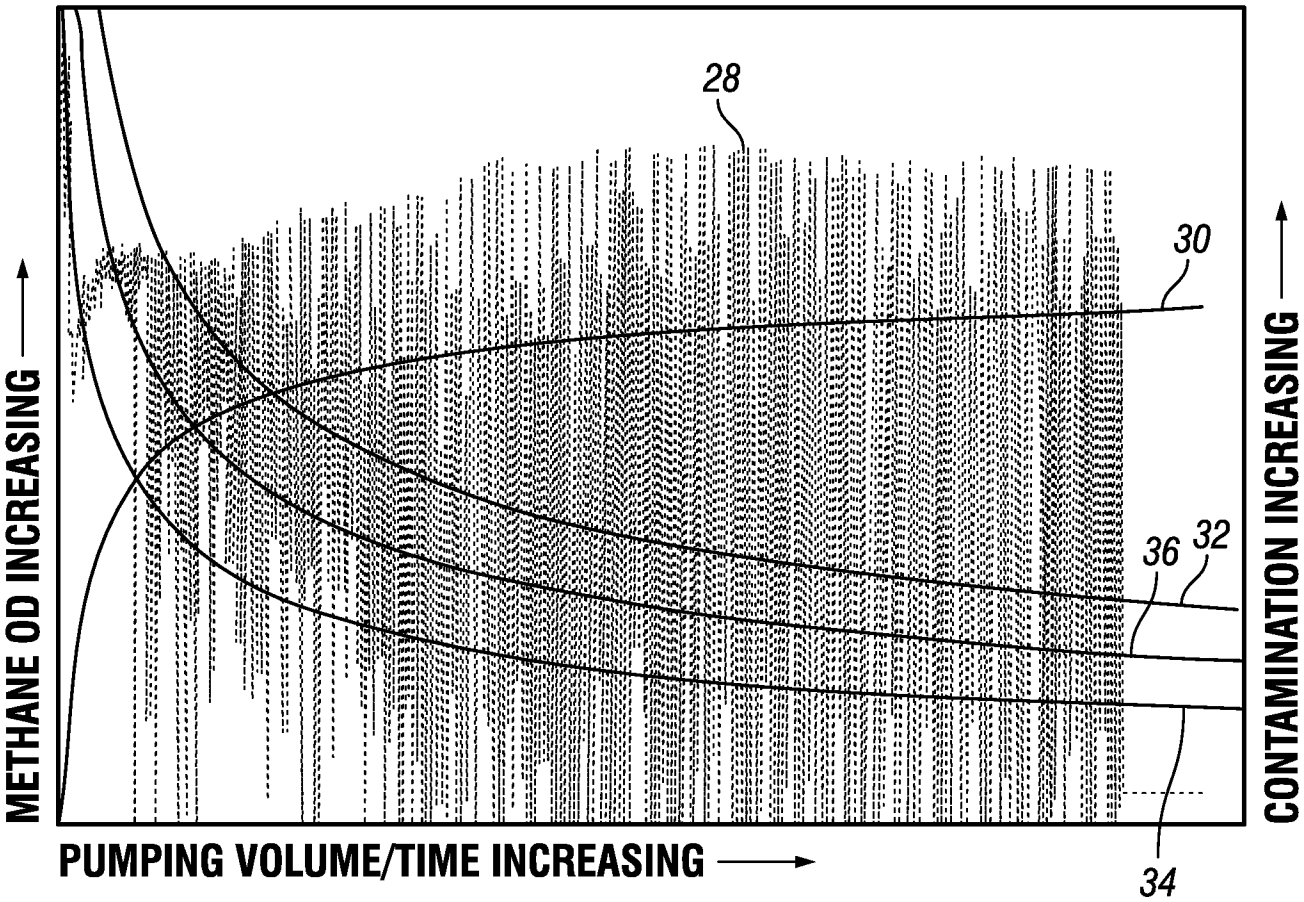
Figure 7:
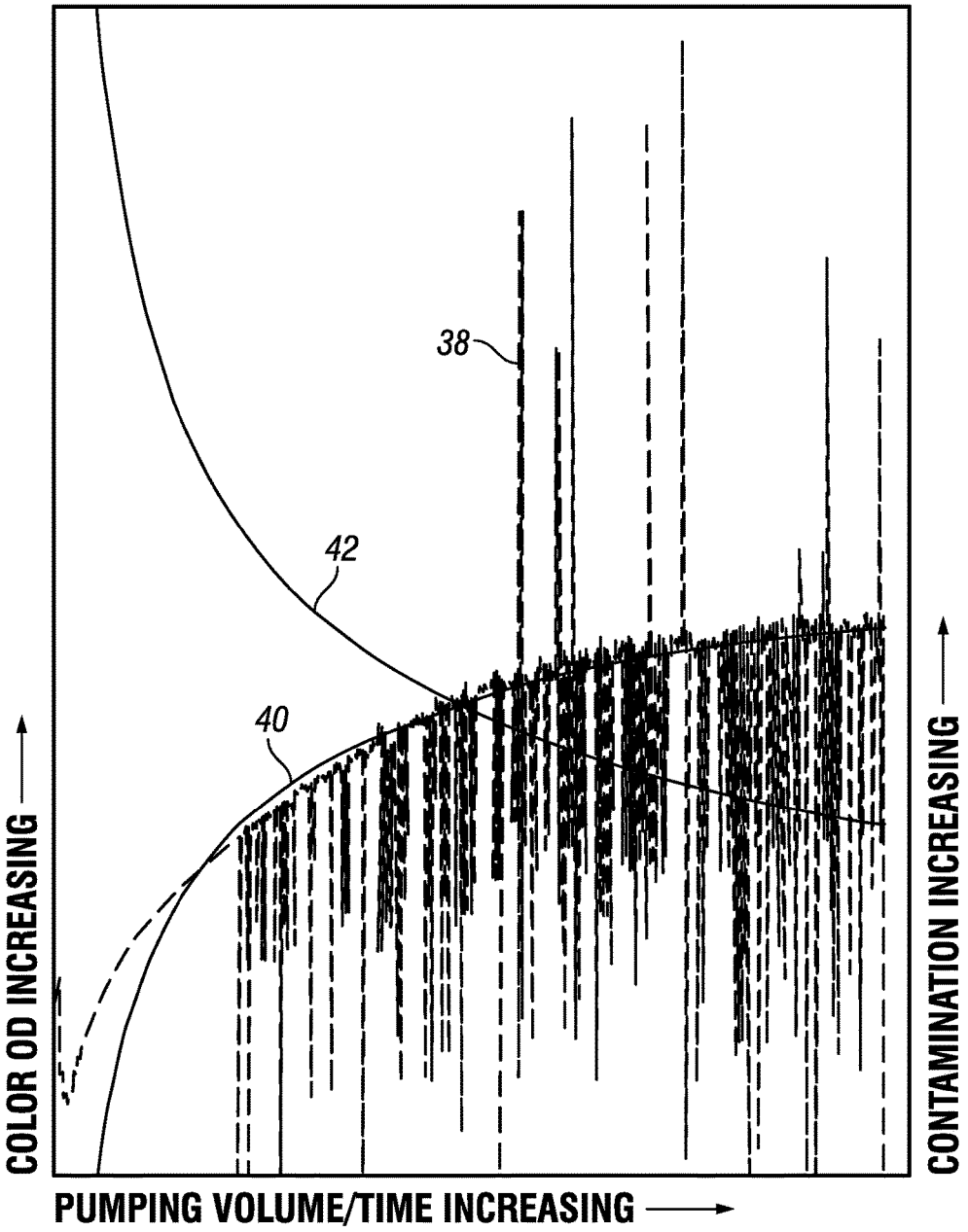
Figure 8:
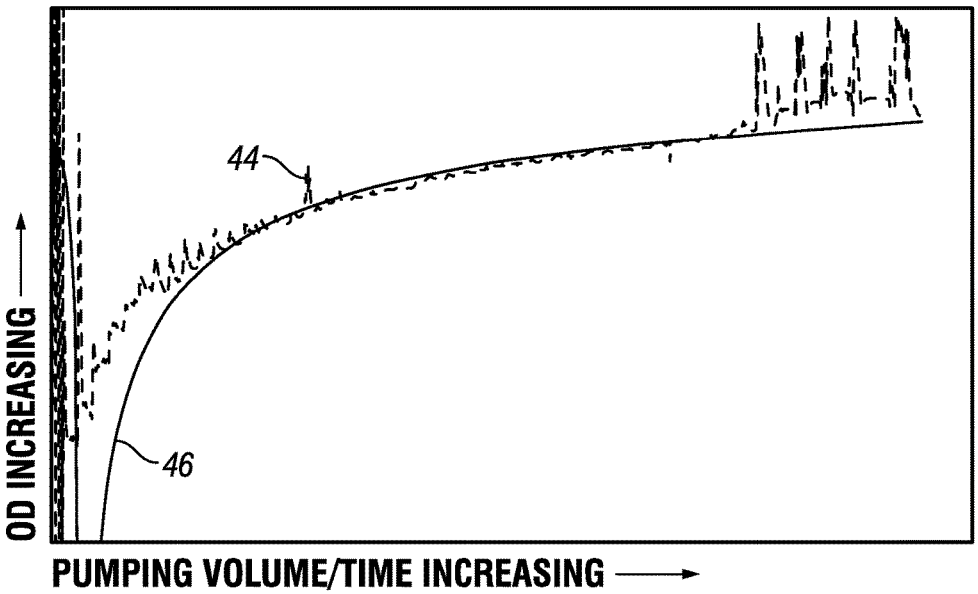
Figure 9:
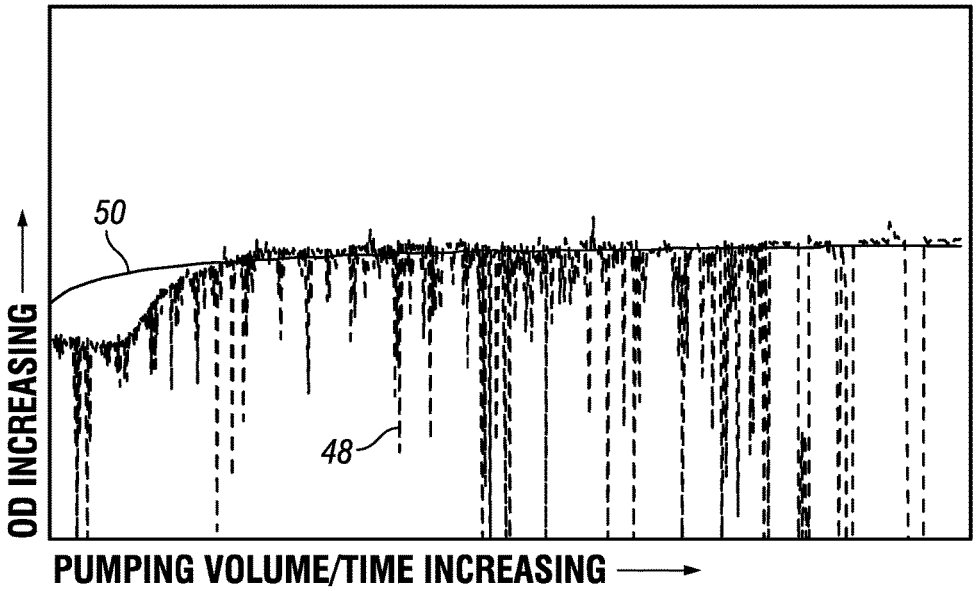

For example, FIGS. 3-9 include several graphs depicting example OD measurements corrupted by scattering noise in various forms. FIG. 3 depicts example optical density data at a wavelength most sensitive to color, or "color OD" data (dashed line 10), versus elapsed pumping time, and the corresponding model (solid line 12). FIG. 4 depicts corresponding example optical density data at a wavelength most sensitive to the presence of methane, or "methane OD" data (dashed line 14), versus elapsed pumping time, and the corresponding model (solid line 16). FIG. 4 also depicts $\nu_{OBM}$ determined based on the color OD data (solid line 18) from FIG. 3, $\nu_{OBM}$ determined based on the methane OD data (solid line 20), and an average thereof (solid line 22). FIG. 5 depicts other example color OD data (dashed line 24) versus elapsed pumping time, and the corresponding model (solid line 26). FIG. 6 depicts corresponding example methane OD data (dashed line 28) versus elapsed pumping time, and the corresponding model (solid line 30). FIG. 6 also depicts $\nu_{OBM}$ determined based on the color OD data (solid line 32) from FIG. 5, $\nu_{OBM}$ determined based on the methane OD data (solid line 34), and an average thereof (solid line 36). FIG. 7 depicts other example color OD data (dashed line 38) versus elapsed pumping time, and the corresponding model (solid line 40). FIG. 7 also depicts $\nu_{OBM}$ determined based on the color OD data (solid line 42). FIG. 8 depicts other example optical density data (dashed line 44) versus elapsed pumping time, and the corresponding model (solid line 46). FIG. 9 depicts other example optical density data (dashed line 48) versus elapsed pumping time, and the corresponding model (solid line 50).

Figure 10:
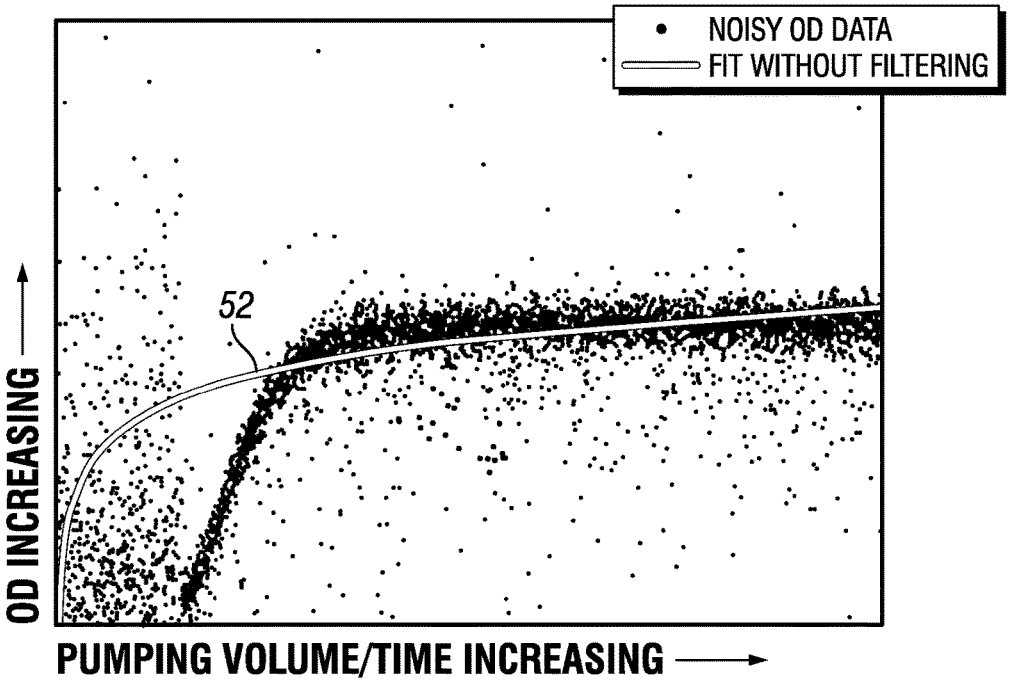
FIG. 10 is a graph depicting example results of fitting unfiltered data.
Figure 11:
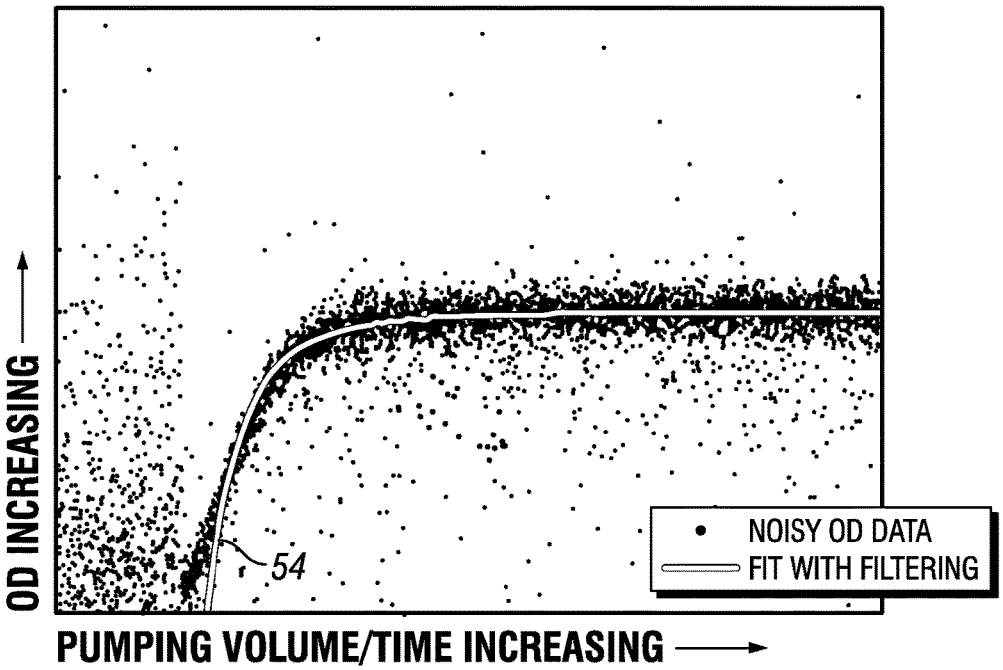
FIG. 11 is a graph depicting example results of fitting data filtered according to one or more aspects of the present disclosure.

As shown in FIGS. 3-9, noisy OD measurement data may show noticeable nonlinear behaviors, such as time-varying and/or non-Gaussian noise. If OD measurement data is significantly corrupted by nonlinear, non-Gaussian noise, the noise can cause the parameter estimation using nonlinear curve fitting to produce large error, as shown in FIG. 10. FIG. 10 is a graph depicting an example nonlinear curve fitting 52 of noisy OD measurement data using Levenberg-Marquardt in least squares sense, resulting in an estimation error of about 231.8%. However, the estimation accuracy can be noticeably improved with some robust filtering techniques. For example, FIG. 11 is a graph depicting an example nonlinear curve fitting 54 of the same OD measurement data using Levenberg-Marquardt in least squares sense, after filtering according to aspects of the present disclosure, resulting in an estimation error reduced to about 1.1%.

For non-Gaussian noise, conventional linear filters (e.g., finite impulse response (FIR) filters) do not produce accurate results, because they produce a more skewed signal due, for example, to the non-symmetric distribution of the noise. Statistical filters such as median and Hampel filters produce better performance, but these filters do not perform smoothing, which makes it difficult to use numerical differentiation methods on their filtered signals. There are more advanced techniques, such as robust LOWESS (locally weighted scatterplot smoothing), that can produce both smoothing and robust filtering for non-Gaussian noise. However, these techniques are computationally expensive, which are not suitable for real-time contamination monitoring.

Figure 12:
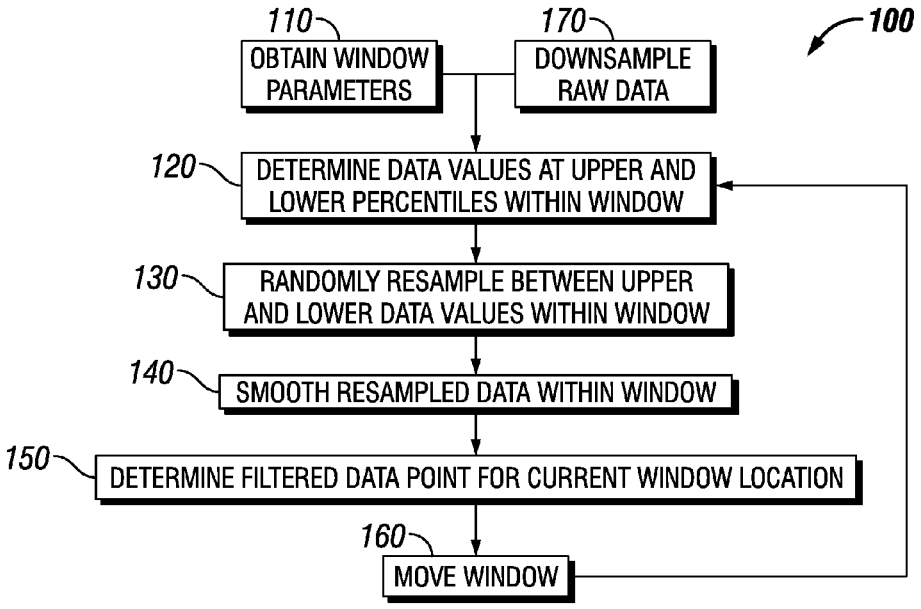
FIG. 12 is a flow-chart diagram of at least a portion of an example implementation of a method according to one or more aspects of the present disclosure.

The present disclosure introduces a robust moving percentile (RMP) filter that combines advantages of both statistical filters and LOWESS. FIG. 12 is a flow-chart diagram of at least a portion of an example implementation of a method (100) of utilizing the RMP filter according to one or more aspects of the present disclosure. The method (100) includes obtaining (110) parameters for a data window that is moved across the data to window locations individually utilized to collectively filter the data. For example, the obtained (110) window parameters may be predetermined settings or user inputs. The obtained (110) parameters include a window size and a window target percentile range between upper and lower percentiles. The window has the same size and target percentile range as the window moves through each location across the data. The window size may be based on number of data points, pumpout volume intervals, or pumpout time intervals. For example, the window size may be a number of data points ranging between five data points and 5,000 data points, a pumpout volume interval ranging between one cubic centimeter (cc) and 100 cc, or a pumpout time interval ranging between five seconds and ten minutes. However, these are merely examples, and other window sizes are also within the scope of the present disclosure. The window target percentile range may be 20%-80%, 40%-60%, or other ranges selected in consideration of noise distribution, computational cost, target and/or expected accuracy, prior knowledge pertaining to the raw measurement data and/or formation, and/or other factors.

At the current window location, the data values corresponding to the upper and lower percentiles of the window are then determined (120). For example, if the obtained (110) upper and lower window target percentiles are 75% and 25%, respectively, the data values corresponding to the 75% and 25% percentiles are determined (120). The upper and lower data values determined (120) to correspond to the upper and lower percentiles, respectively, are then utilized as respective upper and lower bounds for a random resampling (130). That is, the raw measurement data within the window is replaced by random data ranging between the upper and lower data values determined (120) to correspond to the upper and lower percentiles. For example, if the obtained (110) window size is 100 data points, some of the data points will fall outside of the upper and lower data values determined (120) to correspond to the upper and lower percentiles. However, the random resampling (130) replaces the 100 raw data points with 100 random values ranging between the upper and lower data values determined (120) to correspond to the upper and lower percentiles. The random resampling (130) may thus reduce temporal correlations and/or biases.

The randomly resampled (130) data is then smoothed (140), such as by utilizing a weighted linear regression and/or other smoothing techniques, perhaps including algorithms such as ridge regression (also known as Tikhonov regularization) to solve ill-posed problems due to non-unique, unevenly spaced volume data. However, other regression and/or other solutions of ill-posed problems may also or instead be utilized to smooth (140) the randomly resampled (130) data. For example, smoothing (140) the randomly resampled (130) data within the window may comprise weighting the data based on proximity to the center of the window, with centrally located data being weighted more heavily than data near the ends of the window. An example weighting function that may be utilized for weighted linear regression within each individual window is set forth below in Equation (6).

$$y = \frac{1}{2}\left[1 - \cos\left(\frac{\pi}{N/4}x\right)\right] \tag{6}$$

where:

y is the weighting applied to each data point in the window;

N is the number of data points in the window; and x is the location of each data point within the window.

The smoothing (140) is then utilized to determine (150) the filtered data point to utilize for the current window location. For example, if the smoothing (140) includes linear regression (weighted or otherwise) to fit the randomly resampled (130) data to a linear relationship between the data and volume or time, determining (150) the filtered data point to utilize for the current window location may utilize that linear relationship to determine the value corresponding to the center volume or time within the current window. As an example, if the smoothing (140) results in a linear expression Z(V)=A*V+B, where Z is the output of the linear fit model for given data (e.g., randomly resampled data) as a function of pumpout volume V, and where A and B are constants determined via linear regression during the smoothing (140), then determining (150) the filtered data point to utilize for the current window location entails determining $A*V_c+B$, where $V_c$ is the central volume value within the window (or the average of $V_s$, the volume value at the start of the window at the current window location, and $V_e$, the volume value at the end of the window at the current window location).

The window is then moved (160) to the next window location to repeat the determination (120) of the data values corresponding to the upper and lower percentiles in the new window location, the randomly resampling (130) between the determined (120) upper and lower data values, and the smoothing (140) within the new window location. Moving (160) the window may entail moving the window by one, ten, 100, or some other number of data points. For example, if the original data includes twenty data points, the window size is ten data points, and moving (160) the window entails moving the window by one data point, the first iteration of determining (120) the data bounds, resampling (130), smoothing (140), and determining (150) the resulting filtered data point for the first window location may utilize the first through tenth data points from the original 100 data points, the second iteration may utilize the second through eleventh data points, the third iteration may utilize the third through twelfth data points, and so on, resulting in determining (150) eleven filtered data points each corresponding to one of eleven different locations of the moving window.

The method (100) may also comprise downsampling (170) the raw measurement data prior to data filtering and smoothing. For example, the raw measurement data frequency may be high and/or oversampled, such as in implementations in which the raw data is obtained at one Hertz (Hz) intervals, which can result in higher computational cost. The downsampling (170) may reduce the raw data by some multiple or percentage of the measurement frequency utilized to obtain the raw data. For example, raw data obtained with a measurement frequency of 1.0 Hz may be downsampled to a frequency of about 0.33 Hz, thus truncating the raw data to the first data point of each three consecutive data points, or perhaps replacing each set of three consecutive data points with the median or Winsorized mean of the three consecutive data points, among other examples within the scope of the present disclosure. However, the downsampling (170) may utilize various other known or future-developed algorithms.

Figure 13:
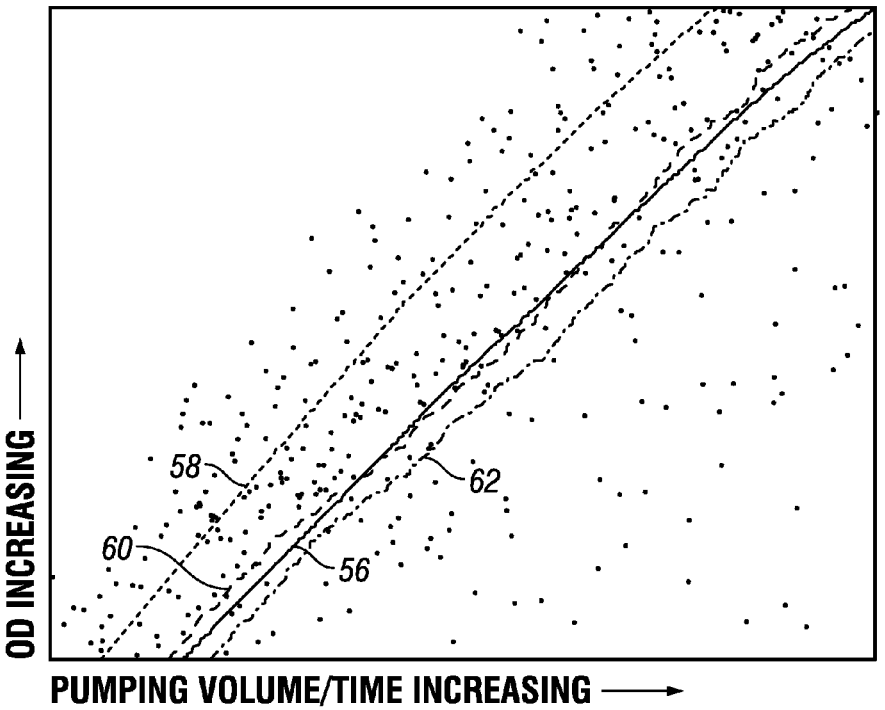
FIG. 13 is a graph depicting example results from utilizing an implementation of the method shown in FIG. 12.

The RMP filtering method (100) may produce more accurate and noticeably smoother fitting compared to statistical filters, as shown in FIG. 13, which depicts example fitting results after utilizing the RMP filter (solid line 56) versus not utilizing a filter (dashed line 58), utilizing a statistical median filter (dashed line 60), and utilizing a Hampel filter (dashed line 62). In addition, the RMP filtering method (100) may be over ten times faster than robust LOWESS. For example, for a data set comprising about 4,100 points, the RMP filter process introduced herein may take about 0.51 seconds, whereas robust LOWESS may take about 6.63 seconds.

Figure 14:
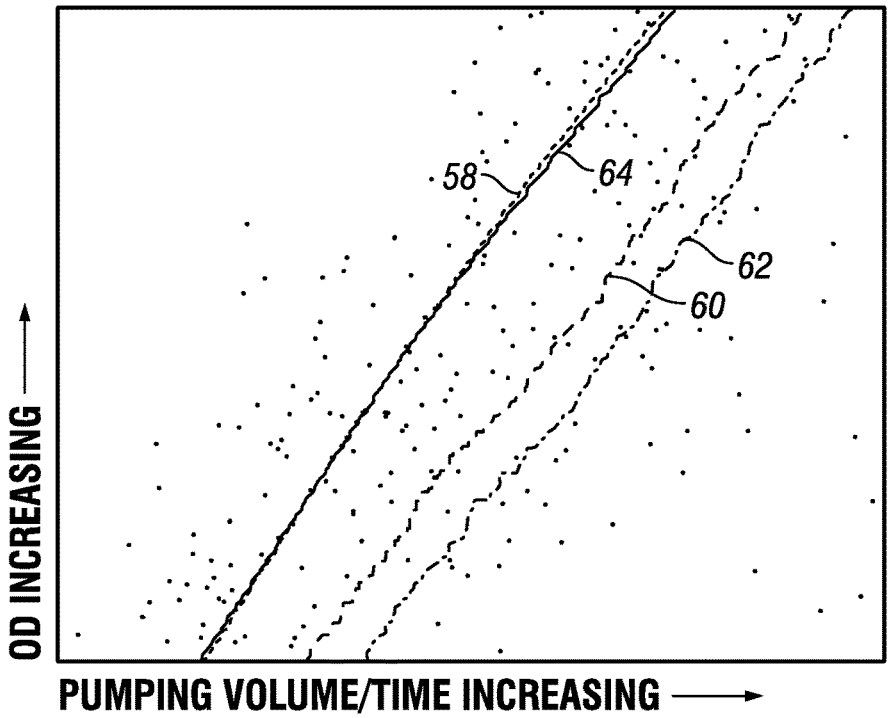
FIG. 14 is a graph depicting other example results from utilizing an implementation of the method shown in FIG. 12.

The RMP filtering method (100) also provides flexibility to investigate different sizes of the moving window, such as when measurement noise may have a non-zero-mean. For example, the percentile range utilized for the moving window in the example shown in FIG. 13 was 30% to 70%, and FIG. 14 depicts the results (solid line 64) utilizing the same data and window size but with a percentile range of 35% to 95%. As shown by FIGS. 13 and 14, the percentile range utilized for processing the windows can be changed to at least somewhat correct the effect of an offset (non-zero-mean) of the data.

Figure 15:
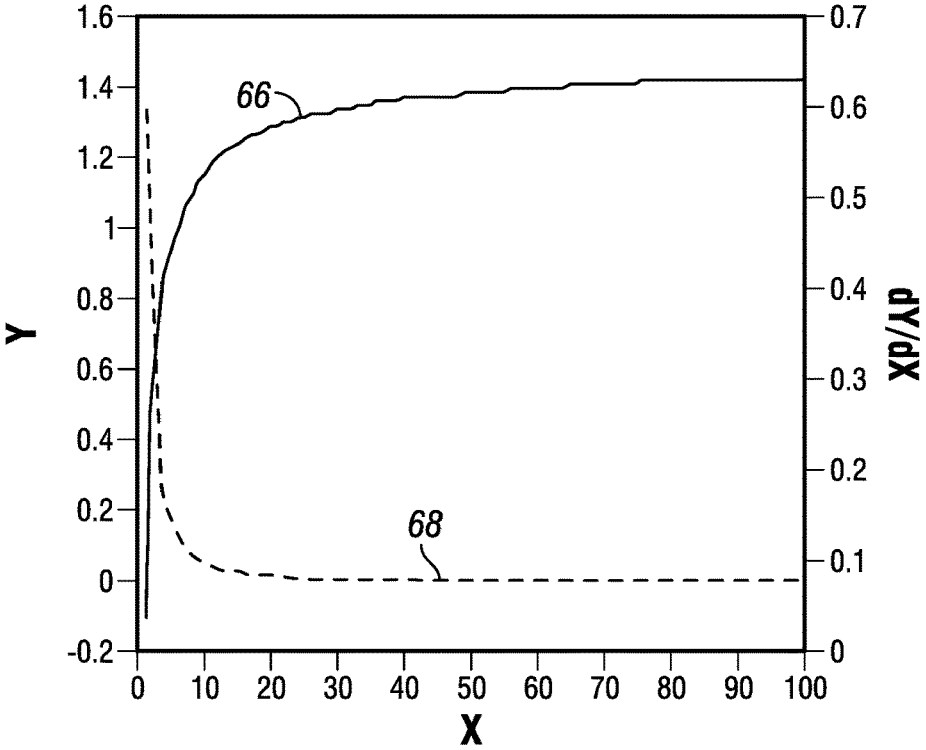
FIG. 15 depicts an example OCM model and its derivative.
Figure 16:
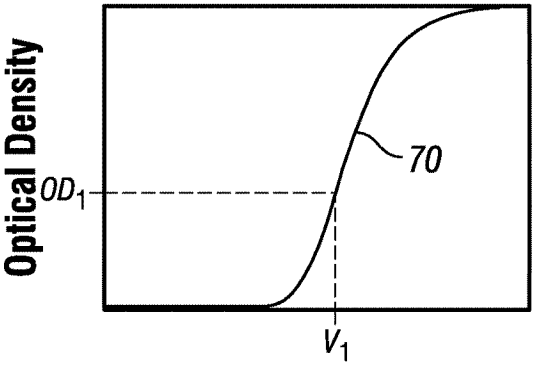
FIGS. 16-18 are graphs depicting example focused sampling sample flowline OD and derivatives at different anisotropic ratios.
Figure 16:
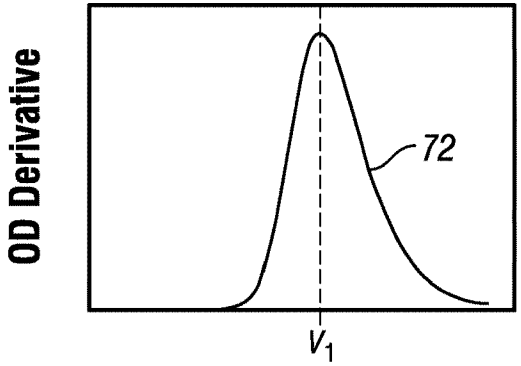
Figure 17:
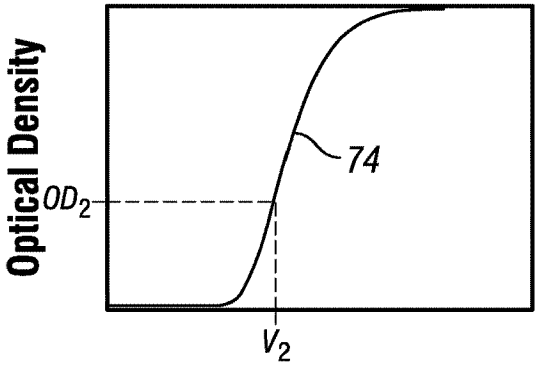
Figure 17:
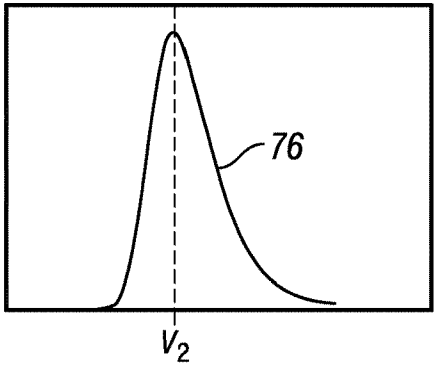
Figure 18:
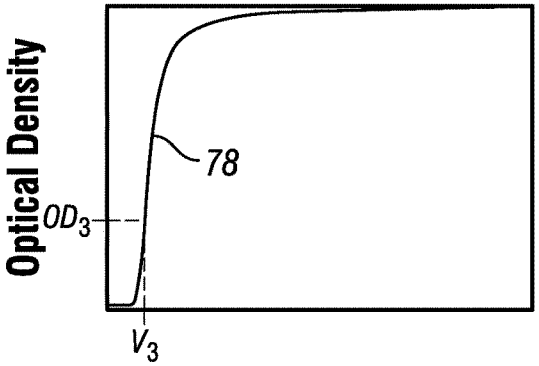
Figure 18:
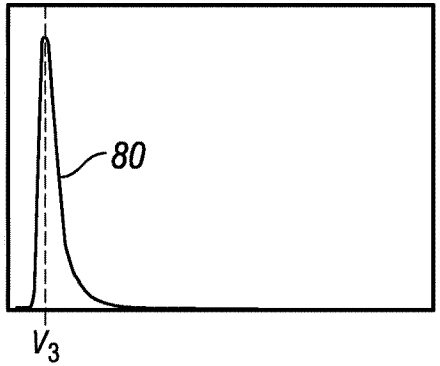

After utilizing one or more implementations of the method (100) to filter the raw measurement data, the filtered data may be utilized for the iterative optimization algorithm via nonlinear curve fitting to estimate $OD_0$ by estimating the three parameters (C, D, and $\gamma$) of the model set forth above in Equation (4). The nonlinear curve fitting utilizes a fit start point. However, the method of determining the fit start point utilized for non-focused sampling data may not be acceptable for focused sampling data. FIG. 15 is a graph depicting an example asymptotic, exponential model of a variable Y (solid line 66) and its derivative (dashed line 68) for non-focused sampling. The derivative 68 monotonically decreases to zero. However, the derivative of optical density and other fluid properties obtained during focused sampling may exhibit an initial increasing trend. For example, FIG. 16 depicts example OD data 70 measured from the sample flowline of a focused sampling tool where the anisotropic ratio is 0.1, as well as the corresponding derivative 72 with respect to pumpout volume V, or dOD/dV Similarly, FIG. 17 depicts other example OD data 74 and the corresponding derivative 76 where the anisotropic ratio is 0.3, and FIG. 18 depicts other example OD data 78 and the corresponding derivative 80 where the anisotropic ratio is 1.0. Although not labeled in FIGS. 16-18 for the sake of clarity, OD and dOD/dV increase upward along the Y-axis, and V increases to the right along the X-axis.

Fluid property data having derivatives that exhibit an increasing trend may not be included in the fitting range due to the monotonicity of the model of Equation (4). Accordingly, the fit start point for focused sampling data may be determined to be at the pumpout volume (or time) at which the derivative of the data reaches a maximum value, or at least not earlier than this volume (or time). For example, if the fluid property data is OD data being utilized for the presently introduced optimization to estimate $OD_0$, the fit start point for the nonlinear curve fitting of the optimization may be determined to be no earlier than the pumpout volume (or time) at which the derivative of the OD data with respect to pumpout volume (or time), or dOD/dV (or dOD/dt), reaches a maximum value. In the example depicted in FIG. 16, the maximum dOD/dV is at a pumpout volume $V_1$, which corresponds to an optical density of $OD_1$. Similarly, the maximum dOD/dV in the example depicted in FIG. 17 is at a pumpout volume $V_2$, which corresponds to an optical density of $OD_2$, and the maximum dOD/dV in the example depicted in FIG. 18 is at a pumpout volume $V_3$, which corresponds to an optical density of $OD_3$.

After determining the start point for fitting the filtered data to the associated model, the fitting may commence. The following description pertains to fitting via parameter estimation using integral error of nonlinearity in logarithmic space. The following description is presented in the context of fitting filtered optical density data. However, as above, optical density is merely an example, and the following description may be adapted for fitting other fluid properties, such as GOR, mass density, shrinkage factor, formation volume factor, fluorescence, conductivity, dielectric constant, viscosity, composition, the f function, or the g function, among other examples.

A common solution for nonlinear parameter estimation problems is to use an iterative optimization algorithm to find a subset of parameters that minimizes model fit error (i.e., nonlinear curve fitting). However, when local optimization algorithms (e.g., Levenberg-Marquardt, trust region algorithms, etc.) are used, the algorithms may produce local solutions with large estimation error. Global optimization algorithms (e.g., genetic algorithms) may produce more accurate estimation in these cases. However, global optimization algorithms may be too computationally intensive to be used for real-time contamination monitoring.

In addition, the nonlinear curve fitting in linear scale using an iterative method may show large sensitivity to different fitting ranges. In the OCM algorithm introduced by the present disclosure, the linearity of the late-phase behavior in logarithmic scale may be used to obtain more accurate and robust extrapolation results.

The OCM model set forth above in Equation (4) may be rearranged as set forth below in Equation (7).

$$C-\mathrm{OD}(V)=D\cdot V^{-\gamma} \tag{7}$$

Taking the logarithm on both sides of Equation (7) provides a linear relationship in terms of log {C−OD(V)} versus log(V), as set forth below in Equation (8).

$$\log\{C-\mathrm{OD}(V)\}=\log D-\gamma\cdot\log V \quad (8)$$

where D and γ may be estimated using a linear least squares method (Equation (5)) because the problem becomes linear. This may eliminate some uncertainties caused by initial parameter values in nonlinear curve fitting with local optimizers.

Figure 19:
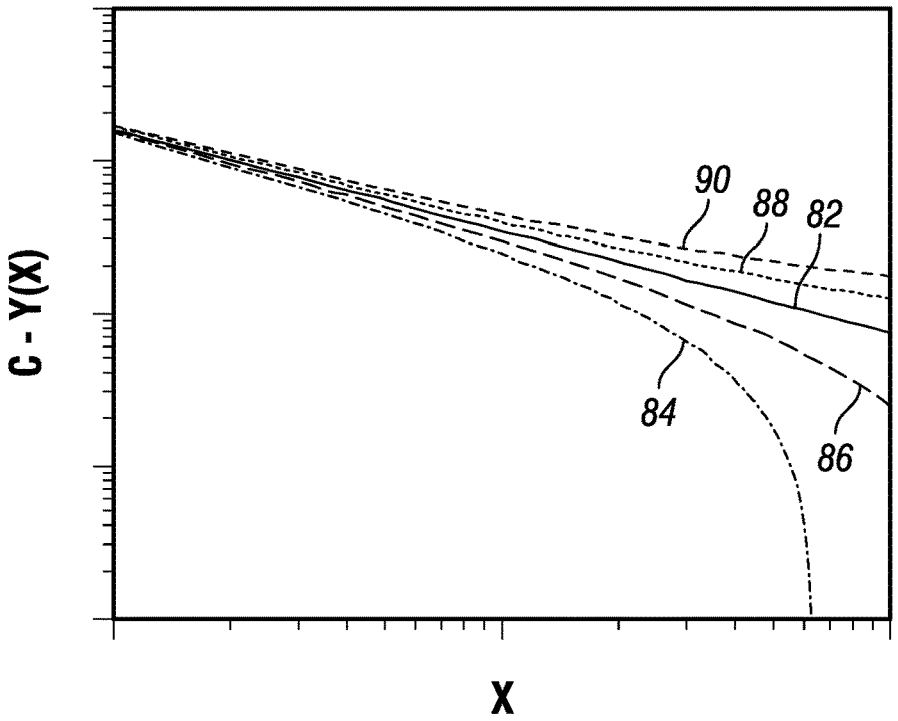
FIG. 19 is a graph depicting one or more aspects of the present disclosure.

However, in the above form, C is also an unknown parameter ($OD_0$) to be estimated. Thus, the present disclosure introduces estimating C based on a given population in an iterative manner, using the linearity of the late-phase behavior in logarithmic scale. FIG. 19 is a graph depicting example behavior of the function log {Ĉ−OD(V)} at the vicinity of the true C value, where Ĉ is estimated C. The Y-axis label Y(X)−C represents the measured data as a function of volume or time minus the estimated C value, where Y(X)=OD(V). The graph of FIG. 19 includes a curve 82 corresponding to the true C of 1.50, as well as a curve 84 for an estimated Ĉ of 1.40, a curve 86 for an estimated Ĉ of 1.45, a curve 88 for an estimated Ĉ of 1.55, and a curve 90 for an estimated Ĉ of 1.60. As shown in FIG. 19, if Ĉ (estimated C) does not equal C (true C), the function log {Ĉ−OD(V)} exhibits large nonlinearity. The concavity of the curves increases as Ĉ becomes increasing larger than the true C (such as curves 88 and 90 in FIG. 19), and the convexity of the curves increases as Ĉ becomes increasing smaller than the true C (such as curves 84 and 86 in FIG. 19)

The integral error of nonlinearity (IEN) in logarithmic scale is defined as the integral of the difference between the function Ĉ=OD(V) and a straight line in logarithmic scale, where the straight line is formed by the first and last points of the function Ĉ−OD(V). Thus, the IEN may be expressed as set forth below in Equation (9).

$$\mathrm{IEN}=\int e\,dV^*,\ \text{where: } e=\log\{\hat{C}-\mathrm{OD}(V)\}-(aV^*+b);\ \text{and } V^*=\log V \quad (9)$$

where a and b are constants of the straight line determined by the first and last points of the function Ĉ−OD(V).

Figure 20:
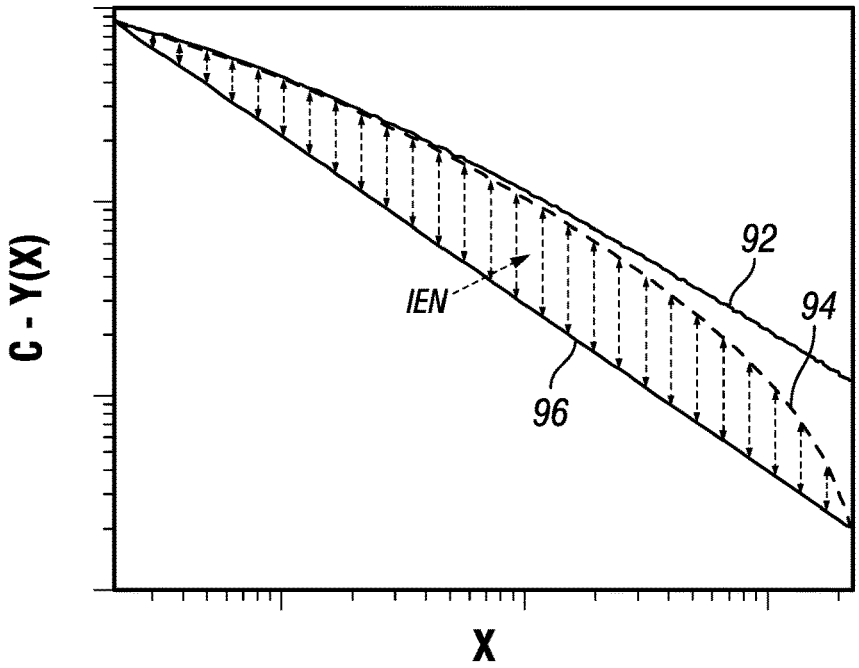
FIG. 20 is a graph depicting one or more aspects of the present disclosure.

An example is depicted in FIG. 20, where a curve 92 corresponds to the true C of 1.50, a curve 94 corresponds to an estimated Ĉ of 1.49, and curve 96 is the straight line between the first and last points of the function Ĉ−OD(V).

The iterative optimization of the present disclosure determines the IEN for multiple different values of Ĉ and determines which Ĉ the IEN. Thus, $C(OD_0)$ may be estimated independently without determining the other parameters (D and γ) of the model, which reduces the dimension of the problem and the uncertainty of the resulting estimation. By changing the solution space, the analysis may focus more on the late-phase behavior, because the IEN may show larger sensitivity toward the end of the data, which may aid in improving estimation accuracy. The analysis conducts the estimation based on the overall linearity of the data in logarithmic scale, whereas nonlinear curve fitting estimates parameters based on overall fitting accuracy. Therefore, the OCM algorithm introduced herein may be less sensitive to the range of fitting relative to previously utilizing nonlinear curve fitting techniques.

However, parameter estimation in logarithmic space may have some numerical issues. If a value for Ĉ is significantly less than C, the function Ĉ−OD(V) becomes negative, because OD measurement becomes larger than Ĉ. In this case, the function log {Ĉ−OD(V)} becomes undefined. In addition, if a value for Ĉ is significantly larger than C, the function log {Ĉ−OD(V)} starts losing concavity due to logarithmic scale, which may mislead the selection of Ĉ based on the integral error. To avoid these issues, the model fit errors in linear space may also be computed using linear least squares fitting, such as by utilizing Equations (10)-(14) set forth below. Then, the determination of Ĉ is conducted within a small range around the solution obtained by the model fit error in linear space.

$$\log D-\gamma\cdot\log V=\log\{\hat{C}-\mathrm{OD}(V)\} \quad (10)$$

$$\text{Let } p_1=\log D,\ p_2=\gamma \quad (11)$$

$$\begin{bmatrix} 1 & -\log V_1 \\ \vdots & \vdots \\ 1 & -\log V_n \end{bmatrix}\begin{bmatrix} p_1 \\ p_2 \end{bmatrix}=\begin{bmatrix} \log\{\hat{C}-OD(V_1)\} \\ \vdots \\ \log\{\hat{C}-OD(V_n)\} \end{bmatrix} \quad (12)$$

$$\hat{D}=e^{p^1}\ \text{(with natural log)},\ \hat{\gamma}=p_2 \quad (13)$$

$$\text{Model fit error in linear space: } e=\mathrm{OD}(V)-[\hat{C}-\hat{D}\times V^{-\hat{\gamma}}] \quad (14)$$

To test the performance of the presently introduced algorithm on actual field data, a set of focused sampling sample flowline OD measurement data was used. The raw measurement data was significantly corrupted by scattering noise. After filtering by the robust moving percentile filter as described above, the maximum derivative peak was located and used as the fitting start point. To understand the sensitivity to fitting range, the algorithm was tested with two different fitting ranges. As shown in Table 1 set forth below, the presently introduced algorithm produced more consistent results compared to nonlinear curve fitting. In addition, the algorithm introduced herein showed faster computation speed.

TABLE 1

| | Estimated OD | | γ | |
|---|---|---|---|---|
| Parameter estimation method | LARGE fitting range | SMALL fitting range | LARGE fitting range | SMALL fitting range |
| Nonlinear curve fitting ($L_2$ minimization) | 0.1582 | 0.1562 | 1.3247 | 2.8792 |
| Nonlinear curve fitting ($L_1$ minimization) | 0.1576 | 0.1563 | 1.5265 | 2.8997 |
| OCM algorithm of the present disclosure | 0.1577 | 0.1575 | 1.3847 | 1.4038 |

Figure 21:
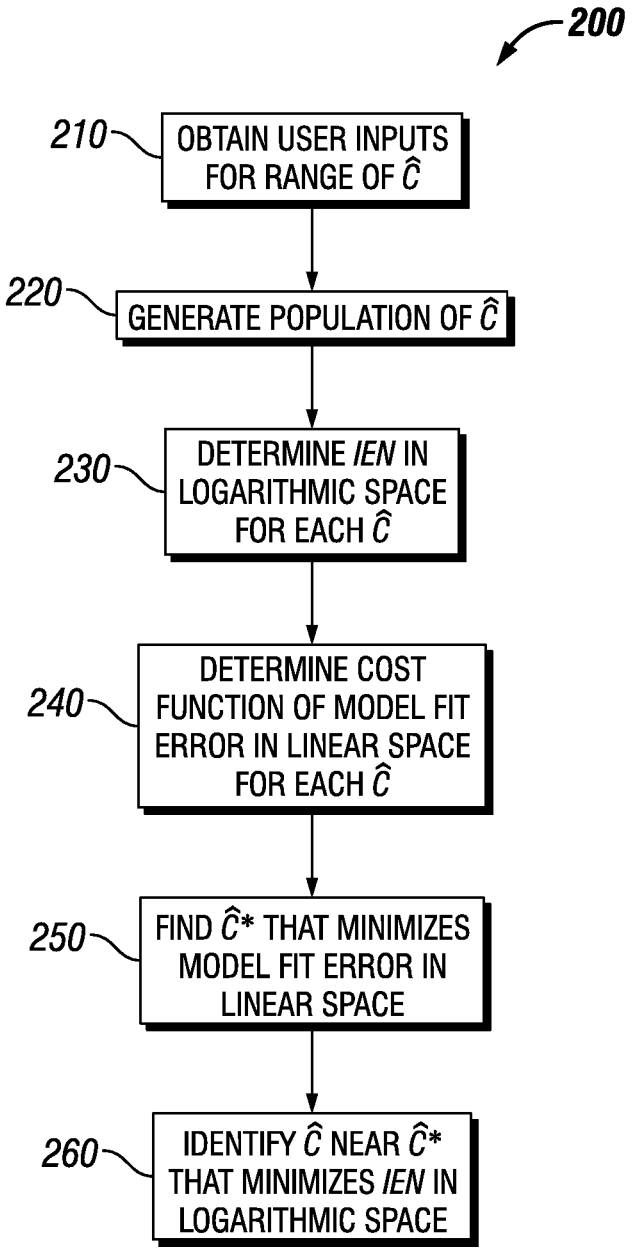
FIG. 21 is a flow-chart diagram of at least a portion of an example implementation of a method according to one or more aspects of the present disclosure.

FIG. 21 is a flow-chart diagram of at least a portion of an example implementation of a method (200) implementing one or more aspects of the parameter estimation algorithm as described above. The method (200) includes obtaining (210) the range of Ĉ and the number of population, such as by user input. For example, in the example depicted in FIG. 19, the range of Ĉ is 1.4 to 1.6, and the population is five. However, other ranges of Ĉ are also within the scope of the present disclosure, such as implementations in which the upper and lower bounds of the range of Ĉ are 10%, 25%, or 50% greater and lower, respectively, than the anticipated true value C, among other examples also within the scope of the present disclosure. The population size may also vary within the scope of the present disclosure, including implementations in which the population size is between two and 50, depending on the intended accuracy, among other factors. If the range of Ĉ is not provided by user input, obtaining (210) the range may comprise obtaining a predetermined range. A lower bound of the predetermined range may be the lowest OD value falling between percentiles of 10%-90% of the OD values, and an upper bound of the predetermined range may be the maximum OD value. However, other examples of the predetermined range are also within the scope of the present disclosure.

The population of the various values of $\hat{C}$ may then be generated (220) based on the obtained (210) range and population values. The IEN in logarithmic space is then determined (230) for each of the values of $\hat{C}$ within the generated (220) population. The regression described above with respect to Equations (10)-(14) is then performed to determine the model (Equation (4)) fit error in linear space to determine (240) corresponding cost functions for each of the values of $\hat{C}$ within the generated (220) population. The fittings performed to determine (230) the IEN and to determine (240) the cost functions of model fit error in linear space may each utilize a fit start point determined by the OD derivative as described above.

The value of $\hat{C}$ that minimizes the model fit error in linear space, denoted by $\hat{C}^*$, may then be found (250). The values of $\hat{C}$ within the vicinity of $\hat{C}^*$ are then searched to identify (260) which value of $\hat{C}$ near $\hat{C}^*$ minimizes the IEN in logarithmic space. The identified (260) value of $\hat{C}$ that minimizes the IEN in logarithmic space near $\hat{C}^*$ is the final estimation of $OD_0$. The values of within the vicinity of $\hat{C}^*$ that are searched may include those values of $\hat{C}$ that vary from the value of $\hat{C}^*$ by a predetermined percentage (e.g., 10%, 25%, etc.) or other threshold, or may simply include a predetermined number of the values of $\hat{C}$ that range around $\hat{C}^*$, such as the five, ten, or other number of values of $\hat{C}$ that form the smallest range having an average or median of $\hat{C}^*$.

Figure 22:
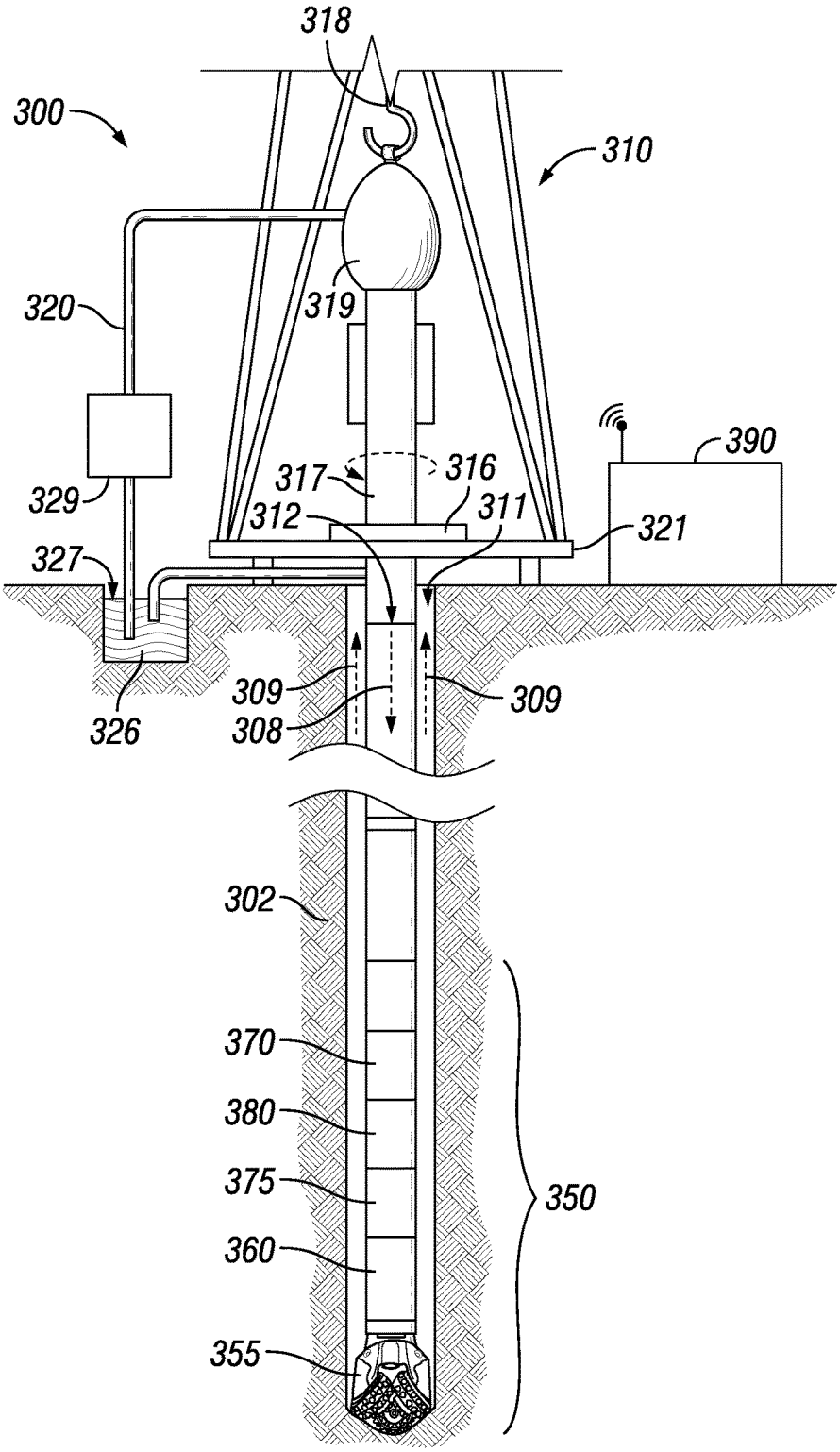
FIG. 22 is a schematic view of at least a portion of an example implementation of apparatus according to one or more aspects of the present disclosure.

FIG. 22 is a schematic view of an example wellsite system 300 in which one or more aspects of OCM disclosed herein may be employed. The wellsite system 300 may be onshore or offshore. In the example system shown in FIG. 22, a borehole 311 is formed in one or more subterranean formations 302 by rotary drilling. However, other example systems within the scope of the present disclosure may also or instead utilize directional drilling.

As shown in FIG. 22, a drillstring 312 suspended within the borehole 311 comprises a bottom hole assembly (BHA) 350 that includes or is coupled with a drill bit 355 at its lower end. The surface system includes a platform and derrick assembly 310 positioned over the borehole 311. The assembly 310 may comprise a rotary table 316, a kelly 317, a hook 318 and a rotary swivel 319. The drill string 312 may be suspended from a lifting gear (not shown) via the hook 318, with the lifting gear being coupled to a mast (not shown) rising above the surface. An example lifting gear includes a crown block whose axis is affixed to the top of the mast, a vertically traveling block to which the hook 318 is attached, and a cable passing through the crown block and the vertically traveling block. In such an example, one end of the cable is affixed to an anchor point, whereas the other end is affixed to a winch to raise and lower the hook 318 and the drillstring 312 coupled thereto. The drillstring 312 comprises one or more types of drill pipes threadedly attached one to another, perhaps including wired drilled pipe.

The drillstring 312 may be raised and lowered by turning the lifting gear with the winch, which may sometimes include temporarily unhooking the drillstring 312 from the lifting gear. In such scenarios, the drillstring 312 may be supported by blocking it with wedges (known as "slips") in a conical recess of the rotary table 316, which is mounted on a platform 321 through which the drillstring 312 passes.

The drillstring 312 may be rotated by the rotary table 316, which engages the kelly 317 at the upper end of the drillstring 312. The drillstring 312 is suspended from the hook 318 and extends through the kelly 317 and the rotary swivel 319 in a manner permitting rotation of the drillstring 312 relative to the hook 318. Other example well site systems within the scope of the present disclosure may utilize a top drive system to suspend and rotate the drillstring 312, whether in addition to or instead of the illustrated rotary table system.

The surface system may further include drilling fluid or mud 326 stored in a pit or other container 327 formed at the wellsite. As described above, the drilling fluid 326 may be OBM or WBM. A pump 329 delivers the drilling fluid 326 to the interior of the drillstring 312 via a hose or other conduit 320 coupled to a port in the swivel 319, causing the drilling fluid to flow downward through the drillstring 312, as indicated in FIG. 22 by the directional arrow 308. The drilling fluid exits the drillstring 312 via ports in the drill bit 355, and then circulates upward through the annulus region between the outside of the drillstring 312 and the wall of the borehole 311, as indicated in FIG. 22 by the directional arrows 309. In this manner, the drilling fluid 326 lubricates the drill bit 355 and carries formation cuttings up to the surface as it is returned to the container 327 for recirculation.

The BHA 350 may comprise one or more specially made drill collars near the drill bit 355. Each such drill collar may comprise one or more logging devices, thereby permitting measurement of downhole drilling conditions and/or various characteristic properties of the formation 302 intersected by the borehole 311. For example, the BHA 350 may comprise a logging-while-drilling (LWD) module 370, a measurement-while-drilling (MWD) module 380, a rotary-steerable system and motor 360, and perhaps the drill bit 355. Of course, other BHA components, modules, and/or tools are also within the scope of the present disclosure, e.g., as represented in FIG. 22 by reference number 375. References herein to a module at the position of 270 may mean a module at the position of 270A as well.

The LWD module 370 may comprise capabilities for measuring, processing, and storing information pertaining to the formation 302, including for obtaining a sample stream of fluid from the formation 302 and performing fluid analysis on the sample stream as described above. The MWD module 380 may comprise one or more devices for measuring characteristics of the drillstring 312 and/or drill bit 355, such as for measuring weight-on-bit, torque, vibration, shock, stick slip, direction, and/or inclination, among other examples within the scope of the present disclosure. The MWD module 380 may further comprise an apparatus (not shown) for generating electrical power to be utilized by the downhole system. This may include a mud turbine generator powered by the flow of the drilling fluid 326. However, other power and/or battery systems may also or instead be employed.

The wellsite system 300 also comprises a logging and control unit and/or other surface equipment 390 communicably coupled to the LWD and MWD modules 370, 375, and 380. One or more of the LWD and MWD modules 370, 375, and 380 comprise a downhole sampling apparatus operable to obtain downhole a sample of fluid from the subterranean formation and perform DFA to measure or determine various fluid properties of the obtained fluid sample. Such DFA may be utilized for OCM according to one or more aspects described above. The resulting data may then be reported to the surface equipment 390.

The operational elements of the BHA 350 may be controlled by one or more electrical control systems within the BHA 350 and/or the surface equipment 390. For example, such control system(s) may include processor capability for characterization of formation fluids in one or more components of the BHA 350 according to one or more aspects of the present disclosure. Methods within the scope of the present disclosure may be embodied in one or more computer programs that run in one or more processors located, for example, in one or more components of the BHA 350 and/or the surface equipment 390. Such programs may utilize data received from one or more components of the BHA 350, for example, via mud-pulse telemetry and/or other telemetry means, and may be operable to transmit control signals to operative elements of the BHA 350. The programs may be stored on a suitable computer-usable storage medium associated with one or more processors of the BHA 350 and/or surface equipment 390, or may be stored on an external computer-usable storage medium that is electronically coupled to such processor(s). The storage medium may be one or more known or future-developed storage media, such as a magnetic disk, an optically readable disk, flash memory, or a readable device of another kind, including a remote storage device coupled over a telemetry link, among other examples.

Figure 23:
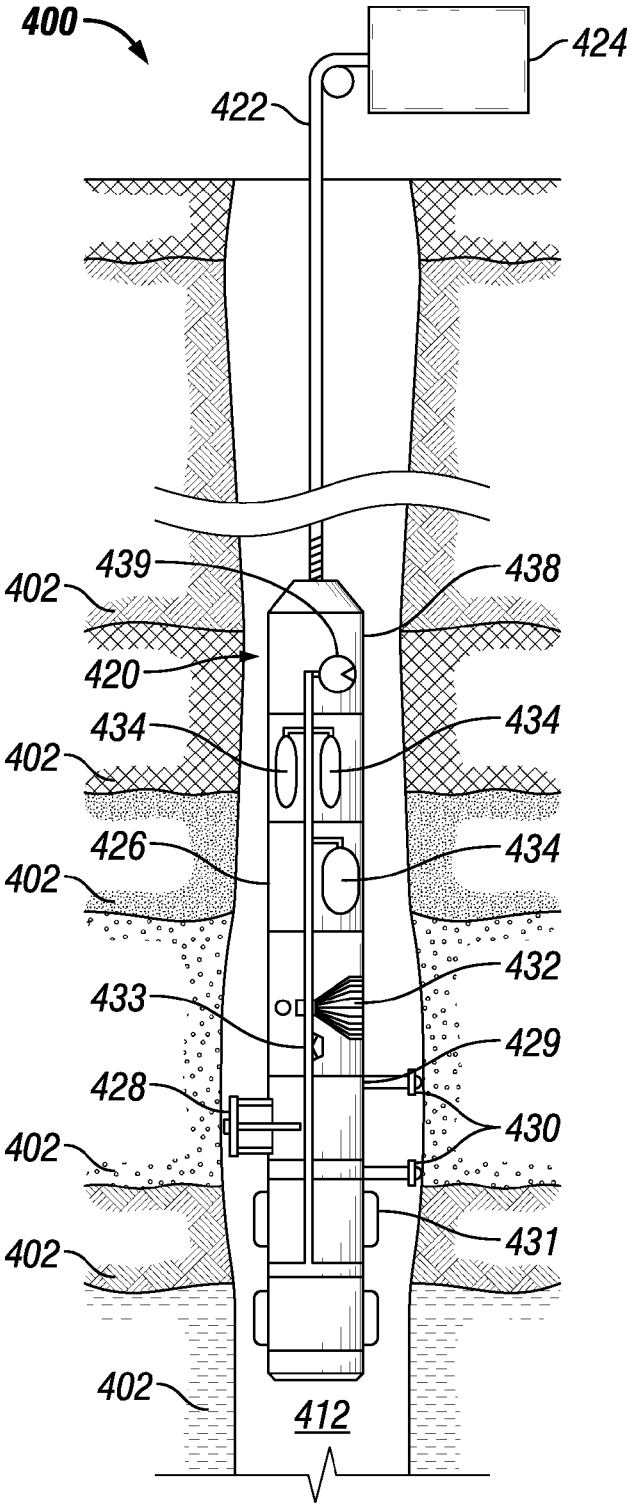
FIG. 23 is a schematic view of at least a portion of an example implementation of apparatus according to one or more aspects of the present disclosure.

FIG. 23 is a schematic view of another example operating environment of the present disclosure wherein a downhole sampling tool 420 is suspended at the end of a wireline 422 at a wellsite having a borehole 412. The downhole sampling tool 420 and wireline 422 are structured and arranged with respect to a service vehicle (not shown) at the wellsite. As with the system 300 shown in FIG. 22, the example system 400 of FIG. 23 may be utilized for downhole sampling and analysis of formation fluids. The system 400 includes the downhole sampling tool 420, which may be used for testing one or more subterranean formations 402 and analyzing the fluids obtained from the formation 402. The system 400 also includes associated telemetry and control devices and electronics (not shown), as well as control, communication, and/or other surface equipment 424. The downhole sampling tool 420 is suspended in the borehole 412 from the lower end of the wireline 422, which may be a multi-conductor logging cable spooled on a winch (not shown). The wireline 422 is electrically coupled to the surface equipment 424, which may have one or more aspects in common with the surface equipment 390 shown in FIG. 22.

The downhole sampling tool 420 comprises an elongated body 426 encasing a variety of electronic components and modules schematically represented in FIG. 23. For example, a selectively extendible fluid admitting assembly 428 and one or more selectively extendible anchoring members 430 are respectively arranged on opposite sides of the elongated body 426. The fluid admitting assembly 428 is operable to selectively seal off or isolate selected portions of the borehole wall 412 such that fluid communication with the adjacent formation 402 may be established. A packer module 431 may also be utilized to establish fluid communication with the adjacent formation 402.

One or more fluid sampling and analysis modules 432 are provided in the tool body 426. Fluids obtained from the formation 402 and/or borehole 412 flow through a flowline 433 of the fluid analysis module or modules 432, and then may be discharged through a port 439 of a pumpout module 438. Alternatively, formation fluids in the flowline 433 may be directed to one or more sample chambers 434 for receiving and retaining the fluids obtained from the formation 402 for transportation to the surface.

The fluid sampling means 429, 431, the fluid analysis modules 432, the flow path (including through the flowline 433, the port 439, and the sample chambers 434), and/or other operational elements of the downhole sampling tool 420 may be controlled by one or more electrical control systems within the downhole sampling tool 420 and/or the surface equipment 424. For example, such control system(s) may include processor capability for characterization of formation fluids in the downhole sampling tool 420 according to one or more aspects of the present disclosure. Methods within the scope of the present disclosure may be embodied in one or more computer programs that run in a processor located, for example, in the downhole sampling tool 420 and/or the surface equipment 424. Such programs may utilize data received from, for example, the fluid sampling and analysis module 432, via the wireline cable 422, and to transmit control signals to operative elements of the downhole sampling tool 420. The programs may be stored on a suitable computer-usable storage medium associated with the one or more processors of the downhole sampling tool 420 and/or surface equipment 424, or may be stored on an external computer-usable storage medium that is electronically coupled to such processor(s). The storage medium may be one or more known or future-developed storage media, such as a magnetic disk, an optically readable disk, flash memory, or a readable device of another kind, including a remote storage device coupled over a switched telecommunication link, among others.

FIGS. 22 and 23 illustrate examples of environments in which one or more aspects of the present disclosure may be implemented. For example, in addition to the drilling environment of FIG. 22 and the wireline environment of FIG. 23, one or more aspects of the present disclosure may be applicable or readily adaptable for implementation in other environments utilizing other means of conveyance within the borehole, including coiled tubing, TLC, slickline, and others.

Figure 24:
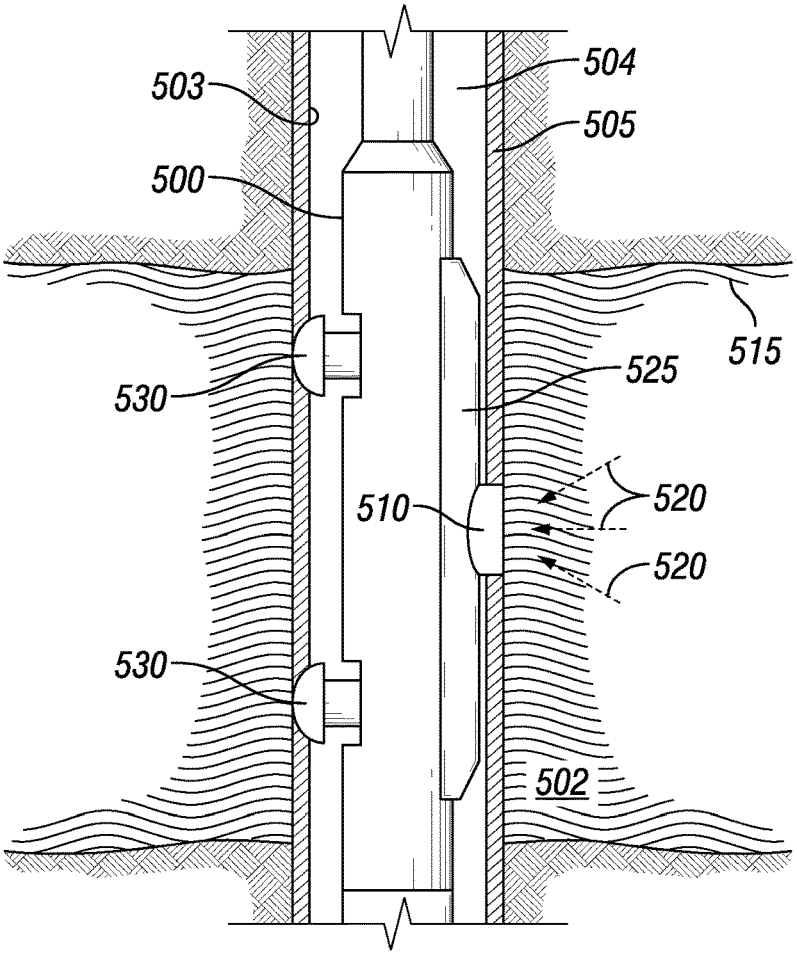
FIG. 24 is a schematic view of at least a portion of an example implementation of apparatus according to one or more aspects of the present disclosure.

An example downhole sampling tool 500 that may be utilized in the example systems 300 and 400 of FIGS. 22 and 23, respectively, such as to obtain a sample of fluid from a subterranean formation 502 and perform DFA for OCM of the obtained fluid sample, is schematically shown in FIG. 24. The downhole sampling tool 500 is provided with a probe 510 for establishing fluid communication with the formation 502 and drawing formation fluid 515 into the tool 500, as indicated in FIG. 24 by arrows 520. The probe 510 may be positioned in a stabilizer blade 525 of the tool 500, and may extend therefrom to engage a wall 503 of a borehole 504, which may have a mudcake layer 506 thereon. The stabilizer blade 525 may be or comprise one or more blades that are in contact with the borehole wall 503 and/or mudcake layer 505. The downhole sampling tool 500 may comprise backup pistons 530 operable to press the downhole sampling tool 500 and, thus, the probe 510 into contact with the borehole wall 503. Fluid drawn into the downhole sampling tool 500 via the probe 510 may be measured to determine various fluid properties described above, for example. The downhole sampling apparatus 500 may also comprise chambers and/or other devices for collecting fluid samples for retrieval at the surface.

Figure 25:
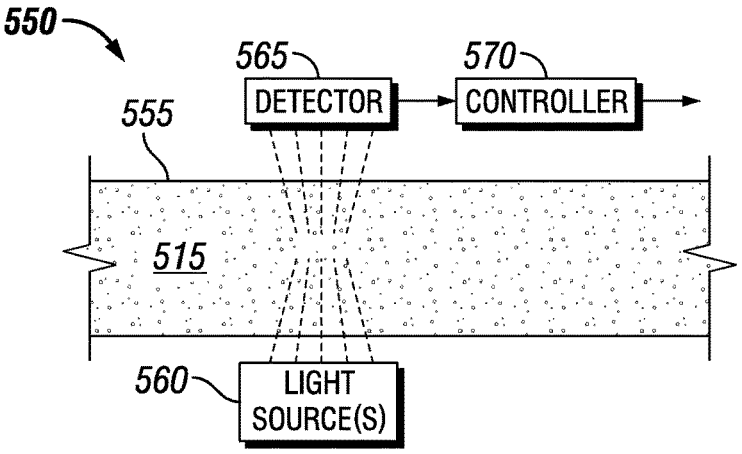
FIG. 25 is a schematic view of at least a portion of an example implementation of apparatus according to one or more aspects of the present disclosure.

An example downhole fluid analyzer 550 that may be used to implement DFA in the example downhole sampling tool 500 shown in FIG. 24 is schematically shown in FIG. 25. The downhole fluid analyzer 550 may be part of or otherwise work in conjunction with a downhole sampling tool operable to obtain a sample of fluid 515 from the formation 502, such as the downhole tools/modules shown in FIGS. 22-24. For example, a flowline 555 of the downhole sampling tool 500 may extend past an optical spectrometer having one or more light sources 560 and a detector 565. The detector 565 senses light that has transmitted through the formation fluid 515 in the flowline 555, resulting in optical spectra that may be utilized according to one or more aspects of the present disclosure. For example, a controller 570 associated with the downhole fluid analyzer 550 and/or the downhole sampling tool 500 may utilize measured optical spectra to perform OCM of the formation fluid 515 in the flowline 555 according to one or more aspects of DFA and/or OCM introduced herein. The resulting information may then be reported via telemetry to surface equipment, such as the surface equipment 390 shown in FIG. 22 and/or the surface equipment 424 shown in FIG. 23. The downhole fluid analyzer 550 may perform the bulk of its processing downhole and report just a relatively small amount of measurement data up to the surface. Thus, the downhole fluid analyzer 550 may provide high-speed (e.g., real-time) DFA measurements using a relatively low bandwidth telemetry communication link. As such, the telemetry communication link may be implemented by most types of communication links, unlike conventional DFA techniques that utilize high-speed communication links to transmit high-bandwidth signals to the surface.

Figure 26:
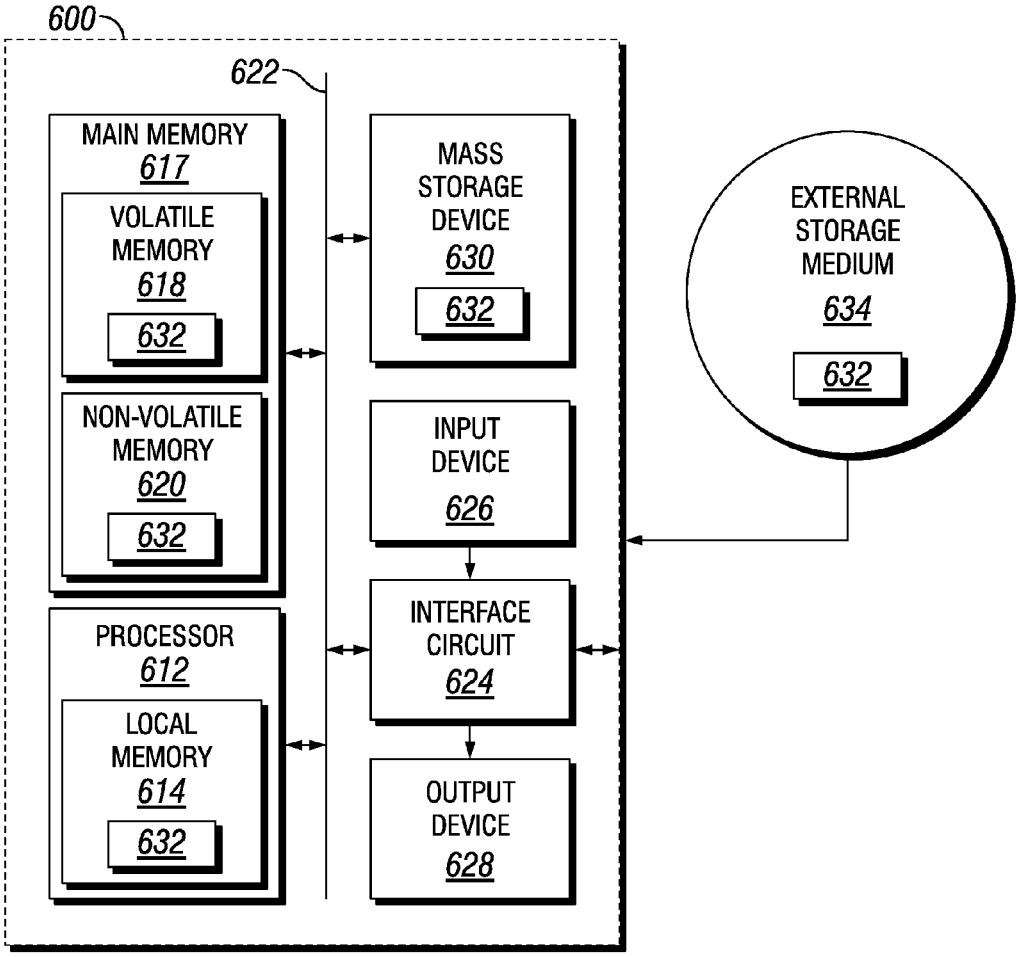
FIG. 26 is a schematic view of at least a portion of an example implementation of apparatus according to one or more aspects of the present disclosure.

FIG. 23 is a schematic view of at least a portion of apparatus according to one or more aspects of the present disclosure. The apparatus is or comprises a processing system 900 that may execute example machine-readable instructions to implement at least a portion of one or more of the methods and/or processes described herein, and/or to implement a portion of one or more of the example downhole tools described herein. The processing system 900 may be or comprise, for example, one or more processors, controllers, special-purpose computing devices, servers, personal computers, personal digital assistant ("PDA") devices, smartphones, internet appliances, and/or other types of computing devices. Moreover, while it is possible that the entirety of the processing system 900 shown in FIG. 26 is implemented within downhole apparatus, such as the LWD and/or MWD modules 270, 275, and/or 280 shown in FIG. 22, the fluid sampling and analysis module 432 shown in FIG. 23, the controller 570 shown in FIG. 25, other components shown in one or more of FIGS. 22-25, and/or other downhole apparatus, it is also contemplated that one or more components or functions of the processing system 900 may be implemented in wellsite surface equipment, perhaps including the surface equipment 390 shown in FIG. 22, the surface equipment 424 shown in FIG. 23, and/or other surface equipment.

The processing system 900 may comprise a processor 912 such as, for example, a general-purpose programmable processor. The processor 912 may comprise a local memory 914, and may execute coded instructions 932 present in the local memory 914 and/or another memory device. The processor 912 may execute, among other things, machine-readable instructions or programs to implement the methods and/or processes described herein. The programs stored in the local memory 914 may include program instructions or computer program code that, when executed by an associated processor, permit surface equipment and/or downhole controller and/or control system to perform tasks as described herein. The processor 912 may be, comprise, or be implemented by one or more processors of various types suitable to the local application environment, and may include one or more of general-purpose computers, special-purpose computers, microprocessors, digital signal processors ("DSPs"), field-programmable gate arrays ("FPGAs"), application-specific integrated circuits ("ASICs"), and processors based on a multi-core processor architecture, as non-limiting examples. Of course, other processors from other families are also appropriate.

The processor 912 may be in communication with a main memory 917, such as may include a volatile memory 918 and a non-volatile memory 920, perhaps via a bus 922 and/or other communication means. The volatile memory 918 may be, comprise, or be implemented by random access memory (RAM), static random access memory (SRAM), synchronous dynamic random access memory (SDRAM), dynamic random access memory (DRAM), RAMBUS dynamic random access memory (RDRAM) and/or other types of random access memory devices. The non-volatile memory 920 may be, comprise, or be implemented by read-only memory, flash memory and/or other types of memory devices. One or more memory controllers (not shown) may control access to the volatile memory 918 and/or the non-volatile memory 920.

The processing system 900 may also comprise an interface circuit 924. The interface circuit 924 may be, comprise, or be implemented by various types of standard interfaces, such as an Ethernet interface, a universal serial bus (USB), a third generation input/output (3GIO) interface, a wireless interface, and/or a cellular interface, among others. The interface circuit 924 may also comprise a graphics driver card. The interface circuit 924 may also comprise a communication device such as a modem or network interface card to facilitate exchange of data with external computing devices via a network (e.g., Ethernet connection, digital subscriber line ("DSL"), telephone line, coaxial cable, cellular telephone system, satellite, etc.).

One or more input devices 926 may be connected to the interface circuit 924. The input device(s) 926 may permit a user to enter data and commands into the processor 912. The input device(s) 926 may be, comprise, or be implemented by, for example, a keyboard, a mouse, a touchscreen, a track-pad, a trackball, an isopoint, and/or a voice recognition system, among others.

One or more output devices 928 may also be connected to the interface circuit 924. The output devices 928 may be, comprise, or be implemented by, for example, display devices (e.g., a liquid crystal display or cathode ray tube display (CRT), among others), printers, and/or speakers, among others.

The processing system 900 may also comprise one or more mass storage devices 930 for storing machine-readable instructions and data. Examples of such mass storage devices 930 include floppy disk drives, hard drive disks, compact disk (CD) drives, and digital versatile disk (DVD) drives, among others. The coded instructions 932 may be stored in the mass storage device 930, the volatile memory 918, the non-volatile memory 920, the local memory 914, and/or on a removable storage medium 934, such as a CD or DVD. Thus, the modules and/or other components of the processing system 900 may be implemented in accordance with hardware (embodied in one or more chips including an integrated circuit such as an application specific integrated circuit), or may be implemented as software or firmware for execution by a processor. In particular, in the case of firmware or software, the embodiment can be provided as a computer program product including a computer readable medium or storage structure embodying computer program code (i.e., software or firmware) thereon for execution by the processor.

Figure 28:
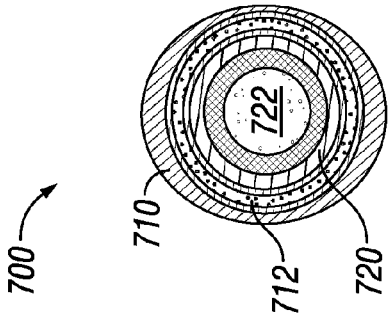
FIGS. 27 and 28 are schematic views of at least a portion of an example implementation of apparatus according to one or more aspects of the present disclosure.
Figure 27:
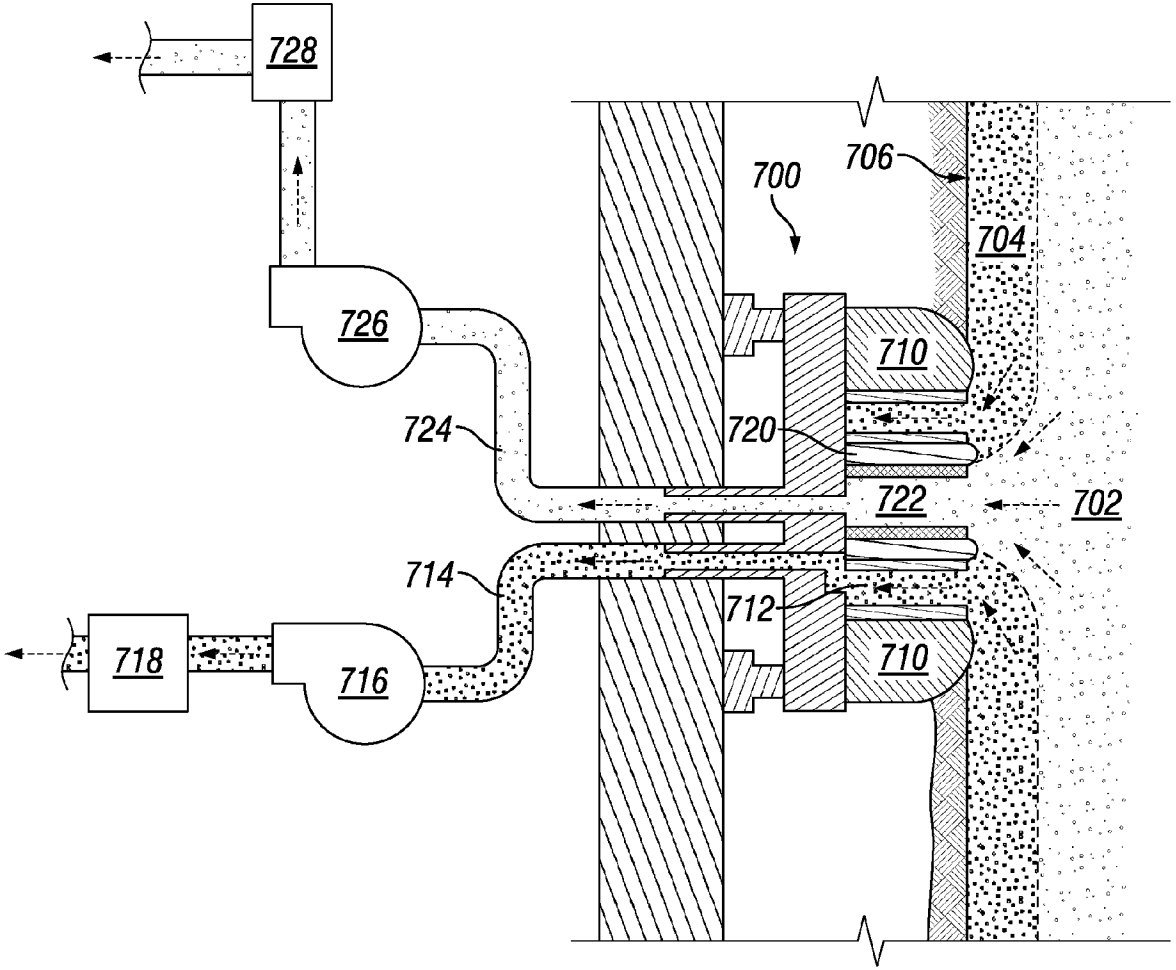

FIGS. 27 and 28 are schematic views of at least a portion of an example implementation of apparatus according to one or more aspects of the present disclosure. As described above, one or more aspects of the present disclosure pertain to focused sampling. FIGS. 27 and 28 depict an example focused sampling apparatus that may be utilized in connection with and/or instead of the apparatus shown in one or more of FIGS. 22-26. Implementations within the scope of the present disclosure may incorporate one or more aspects described below with respect to FIGS. 27 and 28 with one or more aspects described above with respect to one or more of FIGS. 1-26.

In FIG. 27, a focused sampling probe 700 is engaged against a borehole wall 706 such that, after sufficient cleanup time, formation fluid 702 flows into a sample flowline 724 and filtrate contaminated fluid 704 flows into a guard flowline 714. The focused sampling probe 700 includes two concentric probes, including an outer guard probe 712 surrounding a central sampling probe 722. An outer packer 710 and an inner packer 720 surround and separate the probes 712 and 722 and seal against the borehole wall. A pump 716 services the guard flowline 714, and a pump 726 services the sample flowline 714. However, other implementations within the scope of the present disclosure may utilize a single pump or more than one pump instead of the two pumps 716, 726 shown in FIG. 27. Separate pressure gauges and/or other fluid property sensors (not shown) may be provided on each flowline 714, 724, and/or at other locations within the associated hydraulic circuitry. The guard flowline 714 may be in fluid communication with a fluid analyzer 718 operable to analyze the fluid in the guard flowline 714. Similarly, the sample flowline 724 may be in fluid communication with a fluid analyzer 728 operable to analyze the fluid in the sample flowline 724. The fluid analyzers 718, 728 may be the fluid analysis devices described above with respect to one or more of FIGS. 22-26, such as may be utilized to monitor filtrate contamination on the guard and sample flowlines 714, 724, respectively, including as described above with respect to FIGS. 1-21. However, a single fluid analyzer may also be utilized to monitor filtrate contamination of commingled flow achieved by connecting the sample and the guard flowlines hydraulically (not shown).

FIGS. 27 and 28 provide merely one example implementation that may be utilized for focused sampling within the scope of the present disclosure. That is, other focused sampling implementations are also within the scope of the present disclosure, including implementations utilizing multiple packers with flow inlets interposing the packers, as well as single packer implementations in which the single packer includes guard and sample drains.

In view of the entirety of the present disclosure, including the figures and the claims, a person having ordinary skill in the art should readily recognize that the present disclosure introduces a method comprising: obtaining in-situ, real-time data associated with fluid obtained by a downhole sampling tool disposed in a borehole that extends into a subterranean formation, wherein the obtained fluid comprises native formation fluid and filtrate contamination resulting from formation of the borehole, wherein the downhole sampling tool is in electrical communication with surface equipment disposed at a wellsite surface from which the borehole extends, and wherein the obtained data includes a plurality of values of a fluid property of the obtained fluid relative to: a pumpout volume of the fluid pumped from the subterranean formation by the downhole sampling tool; or a pumpout time during which the fluid is pumped from the subterranean formation by the downhole sampling tool. The method also includes, via operation of at least one of the downhole sampling tool and the surface equipment: generating a population of values for $\hat{C}$, wherein each value of $\hat{C}$ an estimated value of the fluid property for the native formation fluid; iteratively fitting the obtained data to a predetermined model in linear space, wherein the model relates the fluid property to the pumpout volume or time, and wherein each iterative fitting utilizes a different one of the values for $\hat{C}$; identifying as $\hat{C}^*$ which one of the values for $\hat{C}$ minimizes model fit error in linear space based on the iterative fitting of the obtained data; selecting ones of the values for $\hat{C}$ that are near $\hat{C}^*$; and determining which one of the selected ones of the values for $\hat{C}$ near $\hat{C}^*$ has a minimum integral error of nonlinearity (LEN) in logarithmic space.

The method may further comprise, via operation of at least one of the downhole sampling tool and the surface equipment, determining a fit start to be utilized for the iterative fitting of the obtained data, wherein determining the fit start may be based on a derivative of the obtained fluid property values with respect to the pumpout volume or time. The fit start may be determined to be no earlier than the pumpout volume or time at which the derivative of the obtained fluid property values reaches a maximum value.

The fluid property may be optical density (OD), and the method may further comprise, via operation of at least one of the downhole sampling tool and the surface equipment, determining the IEN for each of the selected ones of the values for $\hat{C}$ near $\hat{C}^*$ utilizing Equation (9) set forth above. In such implementations, the method may further comprise, via operation of at least one of the downhole sampling tool and the surface equipment, truncating the obtained OD(V) data based on the derivative of the obtained OD(V) data with respect to V, and determining the IEN may utilize the truncated OD(V) data. Truncating the obtained OD(V) data may comprise excluding the obtained OD(V) data obtained prior to the derivative of the obtained OD(V) data reaching a maximum value.

The method may further comprise, via operation of at least one of the downhole sampling tool and the surface equipment, obtaining a range and size of the population of values for $\hat{C}$. Obtaining the range and size may comprise obtaining user inputs and/or obtaining a predetermined range and size.

Iteratively fitting the obtained data to the predetermined model in linear space may comprise performing linear regression to determine one or more adjustable parameters of the predetermined model using linear least squares fitting.

The method may further comprise, via operation of at least one of the downhole sampling tool and the surface equipment, filtering the obtained data utilizing a robust moving percentile (RMP) filter prior to iteratively fitting the obtained data. Filtering the obtained data utilizing the RMP filter may comprise: obtaining parameters for a data window to be moved through a plurality of window locations individually utilized to collectively filter the obtained data, wherein the parameters include a window size and a window target percentile range between upper and lower percentiles; and at each of the plurality of window locations: (i) determining which of the obtained data values correspond to the upper and lower percentiles of the obtained data within the window at the current window location; (ii) replacing the obtained data within the window at the current window location with random data having values ranging between the obtained data values determined to correspond to the upper and lower percentiles; (iii) smoothing the random data; and (iv) determining a filtered data point for the current window location based on the smoothed random data. Smoothing the random data may utilize a weighted linear regression of the random data within the window at the current window location. The weighted linear regression may weight the random data based on position within the window at the current window location, such that the random data located centrally within the window may be weighted more heavily than the random data located near ends of the window.

The present disclosure also introduces a method comprising: obtaining in-situ, real-time data associated with fluid obtained by a downhole sampling tool disposed in a borehole that extends into a subterranean formation, wherein the obtained fluid comprises native formation fluid and filtrate contamination resulting from formation of the borehole, wherein the downhole sampling tool is in electrical communication with surface equipment disposed at a wellsite surface from which the borehole extends, and wherein the obtained data includes a plurality of values of a fluid property of the obtained fluid relative to: a pumpout volume of the fluid pumped from the subterranean formation by the downhole sampling tool; or a pumpout time during which the fluid is pumped from the subterranean formation by the downhole sampling tool. The method also comprises, via operation of at least one of the downhole sampling tool and the surface equipment: generating a population of values for $\hat{C}$, wherein each value of $\hat{C}$ is an estimated value of the fluid property for the native formation fluid; and determining which one of the values for $\hat{C}$ has a minimum integral error of nonlinearity (LEN) in logarithmic space.

The fluid property may be optical density (OD), and the method may further comprise, via operation of at least one of the downhole sampling tool and the surface equipment, determining the IEN for each of the values for $\hat{C}$ utilizing Equation (9) set forth above. In such implementations, the method may further comprise, via operation of at least one of the downhole sampling tool and the surface equipment, truncating the obtained OD(V) data based on a maximum value of the derivative of the obtained OD(V) data with respect to V, and determining the IEN may utilize the truncated OD(V) data.

The present disclosure also introduces a method comprising: obtaining in-situ, real-time data associated with fluid obtained by a downhole sampling tool disposed in a borehole that extends into a subterranean formation, wherein the downhole sampling tool is in electrical communication with surface equipment disposed at a wellsite surface from which the borehole extends, and wherein the obtained data includes a plurality of values of a fluid property of the obtained fluid; and via operation of at least one of the downhole sampling tool and the surface equipment, filtering the obtained data utilizing a robust moving percentile (RMP) filter. Filtering the obtained data utilizing the RMP filter comprises: obtaining parameters for a data window to be moved through a plurality of window locations individually utilized to collectively filter the obtained data, wherein the parameters include a window size and a window target percentile range between upper and lower percentiles; and at each of the plurality of window locations: (i) determining which of the obtained data values correspond to the upper and lower percentiles of the obtained data within the window at the current window location; (ii) replacing the obtained data within the window at the current window location with random data having values ranging between the obtained data values determined to correspond to the upper and lower percentiles; (iii) smoothing the random data; and (iv) determining a filtered data point for the current window location based on the smoothed random data.

Smoothing the random data may utilize a weighted linear regression of the random data within the window at the current window location. The weighted linear regression may weight the random data based on position within the window at the current window location, such that the random data located centrally within the window may be weighted more heavily than the random data located near ends of the window. Obtaining the parameters of the moving data window may comprise obtaining user inputs.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. A method comprising:

obtaining in-situ, real-time data associated with fluid obtained by a downhole sampling tool disposed in a borehole that extends into a subterranean formation, wherein the obtained fluid comprises native formation fluid and filtrate contamination resulting from formation of the borehole, wherein the downhole sampling tool is in electrical communication with surface equipment disposed at a wellsite surface from which the borehole extends, and wherein the obtained data includes a plurality of values of a fluid property of the obtained fluid relative to:

a pumpout volume of the fluid pumped from the subterranean formation by the downhole sampling tool; or a pumpout time during which the fluid is pumped from the subterranean formation by the downhole sampling tool; and via operation of at least one of the downhole sampling tool and the surface equipment:

generating a population of values for $\hat{C}$, wherein each value of $\hat{C}$ is an estimated value of the fluid property for the native formation fluid;

iteratively fitting the obtained data to a model in linear space, wherein the model relates the fluid property to the pumpout volume or time, and wherein each iterative fitting utilizes a different one of the values for $\hat{C}$;

identifying as $\hat{C}^*$ which one of the values for $\hat{C}$ minimizes model fit error in linear space based on the iterative fitting of the obtained data;

selecting ones of the values for $\hat{C}$ that are near $\hat{C}^*$;

determining which one of the selected ones of the values for $\hat{C}$ near $\hat{C}^*$ has an integral error of nonlinearity (IEN) in logarithmic space that is lower than the IENs for each of the other selected ones of the values for $\hat{C}$;

characterizing the native formation fluid based on which one of the selected ones of the values for $\hat{C}$ near $\hat{C}^*$ has an IEN in logarithmic space that is lower than the IENs for the other selected ones of the values for $\hat{C}$; and controlling one or more operational elements of the downhole sampling tool based on the characterization of the native formation fluid.

2. The method of claim 1 further comprising, via operation of at least one of the downhole sampling tool and the surface equipment, determining a fit start to be utilized for the iterative fitting of the obtained data, wherein determining the fit start is based on a derivative of the obtained fluid property values with respect to the pumpout volume or time.

3. The method of claim 2 wherein the fit start is determined to be no earlier than the pumpout volume or time at which the derivative of the obtained fluid property values reaches a maximum value.

4. The method of claim 1 wherein the fluid property is optical density (OD), and wherein the method further comprises, via operation of at least one of the downhole sampling tool and the surface equipment, determining the IEN for each of the selected ones of the values for $\hat{C}$ near $\hat{C}^*$ utilizing:

$$IEN = \int e dV^*, \text{where: } e = \log\{\hat{C} - OD(V)\} - (aV^* + b); \text{ and } V^* = \log V$$

where OD(V) is obtained optical density data with respect to pumpout volume (V), and a and b are constants of a straight line determined by first and last points of the function $\hat{C}$−OD(V).

5. The method of claim 4 further comprising, via operation of at least one of the downhole sampling tool and the surface equipment, truncating the obtained OD(V) data based on the derivative of the obtained OD(V) data with respect to V, wherein determining the IEN utilizes the truncated OD(V) data.

6. The method of claim 5 wherein truncating the obtained OD(V) data comprises excluding the obtained OD(V) data obtained prior to the derivative of the obtained OD(V) data reaching a maximum value.

7. The method of claim 1 further comprising, via operation of at least one of the downhole sampling tool and the surface equipment, obtaining a range and size of the population of values for $\hat{C}$.

8. The method of claim 7 wherein obtaining the range and size comprises obtaining user inputs.

9. The method of claim 7 wherein obtaining the range and size comprises obtaining a range and size that is based on settings or user inputs.

10. The method of claim 1 wherein iteratively fitting the obtained data to the model in linear space comprises performing linear regression to determine one or more adjustable parameters of the model using linear least squares fitting.

11. The method of claim 1 further comprising, via operation of at least one of the downhole sampling tool and the surface equipment, filtering the obtained data utilizing a robust moving percentile (RMP) filter prior to iteratively fitting the obtained data.

12. The method of claim 11 wherein filtering the obtained data utilizing the RMP filter comprises:

obtaining parameters for a data window to be moved through a plurality of window locations individually utilized to collectively filter the obtained data, wherein the parameters include a window size and a window target percentile range between upper and lower percentiles; and at each of the plurality of window locations:

determining which of the obtained data values correspond to the upper and lower percentiles of the obtained data within the window at a current window location;

replacing the obtained data within the window at the current window location with random data having values ranging between the obtained data values determined to correspond to the upper and lower percentiles;

smoothing the random data; and determining a filtered data point for the current window location based on the smoothed random data.

13. The method of claim 12 wherein smoothing the random data utilizes a weighted linear regression of the random data within the window at the current window location.

14. The method of claim 13 wherein the weighted linear regression weights the random data based on position within the window at the current window location, such that the random data located centrally within the window is weighted more heavily than the random data located near ends of the window.

15. A method comprising:

obtaining in-situ, real-time data associated with fluid obtained by a downhole sampling tool disposed in a borehole that extends into a subterranean formation, wherein the obtained fluid comprises native formation fluid and filtrate contamination resulting from formation of the borehole, wherein the downhole sampling tool is in electrical communication with surface equipment disposed at a wellsite surface from which the borehole extends, and wherein the obtained data includes a plurality of values of a fluid property of the obtained fluid relative to:

a pumpout volume of the fluid pumped from the subterranean formation by the downhole sampling tool; or a pumpout time during which the fluid is pumped from the subterranean formation by the downhole sampling tool; and via operation of at least one of the downhole sampling tool and the surface equipment:

generating a population of values for $\hat{C}$, wherein each value of $\hat{C}$ is an estimated value of the fluid property for the native formation fluid;

determining which one of the values for $\hat{C}$ has an integral error of nonlinearity (IEN) in logarithmic space that is lower than the IENs for each of the other ones of the values for $\hat{C}$;

characterizing the native formation fluid based on which one of the values for $\hat{C}$ near $\hat{C}$ has an IEN in logarithmic space that is lower than the IENs for the other ones of the values for $\hat{C}$; and controlling one or more operational elements of the downhole sampling tool based on the characterization of the native formation fluid.

16. The method of claim 15 wherein the fluid property is optical density (OD), and wherein the method further comprises, via operation of at least one of the downhole sampling tool and the surface equipment, determining the IEN for each of the values for $\hat{C}$ utilizing:

$$IEN = \int e dV^*, \text{where: } e = \log\{\hat{C} - OD(V)\} - (aV^* + b); \text{ and } V^* = \log V$$

where OD(V) is obtained optical density data with respect to pumpout volume (V), and a and b are constants of a straight line determined by first and last points of the function $\hat{C}$−OD(V).

17. The method of claim 16 further comprising, via operation of at least one of the downhole sampling tool and the surface equipment, truncating the obtained OD(V) data based on a maximum value of the derivative of the obtained OD(V) data with respect to V, wherein determining the IEN utilizes the truncated OD(V) data.

18. A method comprising:

obtaining in-situ, real-time data associated with fluid obtained by a downhole sampling tool disposed in a borehole that extends into a subterranean formation, wherein the downhole sampling tool is in electrical communication with surface equipment disposed at a wellsite surface from which the borehole extends, and wherein the obtained data includes a plurality of values of a fluid property of the obtained fluid; and via operation of at least one of the downhole sampling tool and the surface equipment, filtering the obtained data utilizing a robust moving percentile (RMP) filter by:

obtaining parameters for a data window to be moved through a plurality of window locations individually utilized to collectively filter the obtained data, wherein the parameters include a window size and a window target percentile range between upper and lower percentiles; and at each of the plurality of window locations:

determining which of the obtained data values correspond to the upper and lower percentiles of the obtained data within the window at a current window location;

replacing the obtained data within the window at the current window location with random data having values ranging between the obtained data values determined to correspond to the upper and lower percentiles;

smoothing the random data;

determining a filtered data point for the current window location based on the smoothed random data;

characterizing the obtained fluid based on the filtered data point; and controlling one or more operational elements of the downhole sampling tool based on the characterization of the obtained fluid.

19. The method of claim 18 wherein smoothing the random data utilizes a weighted linear regression of the random data within the window at the current window location, and wherein the weighted linear regression weights the random data based on position within the window at the current window location, such that the random data located centrally within the window is weighted more heavily than the random data located near ends of the window.

20. The method of claim 18 wherein obtaining the parameters of the moving data window comprises obtaining user inputs.

* * * * *